US006354509B1

(12) United States Patent
Fukuda et al.

(10) Patent No.: US 6,354,509 B1
(45) Date of Patent: Mar. 12, 2002

(54) THERMAL EXPANSION VALVE

(75) Inventors: Eiji Fukuda; Kazuhiko Watanabe, both of Toyko (JP)

(73) Assignee: Fujikoki Mfg. Co., Ltd., Tokyo (JP)

( * ) Notice: Subject to any disclaimer, the term of this patent is extended or adjusted under 35 U.S.C. 154(b) by 0 days.

(21) Appl. No.: 09/706,780

(22) Filed: Nov. 7, 2000

(30) Foreign Application Priority Data

Nov. 10, 1999 (JP) ..... 11-319892
Dec. 9, 1999 (JP) ..... 11-350701

(51) Int. Cl.[7] ..... G05D 27/00
(52) U.S. Cl. ..... 236/92 B; 62/225
(58) Field of Search ..... 62/225, 527; 236/92 B, 236/92 R

(56) References Cited

U.S. PATENT DOCUMENTS 4,342,421 A * 8/1982 Widdowson ..... 236/92 B
4,984,735 A * 1/1991 Glennon et al. ..... 236/92 B
D415,564 S * 10/1999 Sendo et al. ..... 236/92 B

* cited by examiner

*Primary Examiner*—William Doerrler
*Assistant Examiner*—Mohammad M Ali
(74) *Attorney, Agent, or Firm*—Rader, Fishman & Grauer, PLLC

(57) ABSTRACT

A thermal expansion valve 100 has a valve chamber in a valve body 110, and controls the flow rate of refrigerant from a condenser and a receiver, and the refrigerant travels to an evaporator through a passage 132. Refrigerant returning from the evaporator transmits the temperature of refrigerant to a heat sensing shaft connecting to a power element portion 36 while traveling through a passage 34. A cover 200 has a head portion 220 and a tapered portion 210, and is mounted to the top portion of the valve body 110. Tapered outer surfaces 212 of the tapered portion of the cover 200 and tapered surfaces 114 of the valve body 110 form approximately identical surfaces. A concave portion 221 of the head portion 220 covers the power element portion 36, and its peak portion forms a curved surface 222.

11 Claims, 25 Drawing Sheets

THERMAL EXPANSION VALVE

FIELD OF THE INVENTION

This invention relates to a thermal expansion valve used in a refrigeration cycle.

DESCRIPTION OF THE RELATED ART

Generally, of the components forming the refrigeration cycle in an air conditioner for vehicles, the evaporator is placed inside the passenger room, and others such as the compressor and the like are placed inside the engine room. The refrigeration cycle is provided with a thermal expansion valve for controlling the amount of refrigerant entering the evaporator.

FIG. 26 is a vertical cross-sectional view showing the state where a box-type expansion valve conventionally used as an expansion valve is placed in the refrigeration cycle of the air conditioner used for a vehicle, and FIG. 27 is a schematic perspective view of the same. In FIG. 26, an expansion valve 10 is formed of a prismatic valve body 30 made from aluminum and the like, a first passage 32 through which refrigerant travels from a condenser 5 via a receiver 6 to an evaporator 8 in a refrigeration cycle 11, and a second passage 34 through which refrigerant travels from the evaporator 8 to a compressor 4, both passages being formed on the valve body 30 and placed vertically apart from each other. Also, the expansion valve 10 includes an orifice 32*a* and a valve chamber 35 provided to the first passage 32, a spherical valve means 32*b* provided to the upstream side of the passage 32 for controlling the amount of refrigerant traveling through the orifice 32*a*, and an adjust screw 39 for a spring 32*d* providing pressure to the valve means 32*b* in the direction toward the orifice 32*a* through a valve member 32*c*. The adjust screw 39 having a screw portion 39*f* is screwed retrievably to a mount hole 30*a* connecting to the valve chamber 35 of the first passage 32 from the lower end surface of the valve body 30, and an O-ring 39*g* is mounted to the adjust screw 39 so as to secure airtightness of the valve body 30. The opening of the valve means 32*d* to the orifice 32*a* is adjusted by the adjust screw 39 and the pressure spring 32*d*.

Reference number 321 is an entrance port where refrigerant exiting the receiver 6 and traveling toward the evaporator 8 enters. The entrance port 321 is connected to the valve chamber 35, and reference number 322 is an exit port of the refrigerant flowing into the evaporator 8. Also, reference number 50 of FIG. 27 shows bolt holes for mounting the expansion valve, and the lower portion of the valve body 30 is thinned. A small-diameter aperture 37 for opening and closing the orifice 32*a* by providing driving force to the valve means 32*b* corresponding to the exit temperature of the evaporator 8, and an aperture 38 having a larger diameter than the aperture 37 are provided to the valve body 30 coaxial to the orifice 32*a*. A screw hole 361 for fixing the power element portion 36 as a heat sensing portion is provided to the upper end of the valve body 30.

The power element portion 36 constitutes a diaphragm 36*a* made of stainless steel and the like, and an upper pressure working chamber 36*b* and a lower pressure working chamber 36*c* formed coherent to each other by welding while interposing the diaphragm 36*a*, forming two airtight heat sensing chambers above and below the diaphragm 36*a*. The power element portion 36 is equipped with an upper lid 36*d* and a lower lid 36*h* made of stainless steel and the like, and a plug body 36*k* for enclosing predetermined refrigerant acting as a diaphragm driving fluid to the upper pressure working chamber 36*b*, and the lower lid 36*h* is screwed into a screw hole 361 through a packing 40. The lower pressure working chamber 36*c* is connected to the second passage 34 through an equalizing hole 36*e* formed concentric with the center line of the orifice 32*a*. Refrigerant from the evaporator 8 travels through the second passage 34, and the passage 34 becomes the passage for vapor refrigerant, and the pressure of the refrigerant is loaded to the lower pressure working chamber 36*c* through the pressure equalizing hole 36*e*. Reference number 342 is an entrance port where refrigerant exiting the evaporator 8 enters, and 341 is an exit port where refrigerant discharged to the compressor 4 exits.

Also, a peak portion 312 formed in a large-diameter saucer which comes into contact with the central portion of the lower surface of the diaphragm 36*a* is provided inside the lower pressure working chamber 36*c*. The power element portion 36 is further comprised of a heat sensing shaft 36*f* made of aluminum which pierces through the second passage 34 and is arranged slidably inside the large-diameter aperture 38 to transmit the temperature at the refrigerant exit of the evaporator 8 to the lower pressure working chamber 36*c* and which provides driving force by sliding inside the large-diameter aperture 38 corresponding to the displacement of the diaphragm 36*a* based on the difference in pressure between the upper pressure working chamber 36*b* and the lower pressure working chamber 36*c*, and a working shaft 37*f* made of stainless steel and having a smaller diameter than the heat sensing shaft 36*f* which is arranged slidably inside the small-diameter aperture 37 to provide pressure to the valve means 32*b* resisting to the elastic force of the spring means 32*d* corresponding to the displacement of the heat sensing shaft 36*f*. The upper end portion of the heat sensing shaft 36*f* is composed from a peak portion 312 as a receiving portion of the diaphragm 36*a* and a large-diameter portion 314 sliding inside the lower pressure working chamber 36*c*, and the lower end portion of the heat sensing shaft 36*f* comes into contact with the upper end portion of the working shaft 37*f*, the lower end portion of the working shaft 37*f* comes into contact with the valve means 32*b*, so that the heat sensing shaft 36*f* and the working shaft 37*f* constitute altogether the valve means driving shaft 318. The peak portion 312 and the large-diameter portion 314 may be formed as one member.

That is, the valve means driving shaft 318 extending from the lower surface of the diaphragm 36*a* to the orifice 32*a* of the first passage 32 is concentrically arranged in the equalizing hole 36*e*. The portion 37*e* of the working shaft 37*f* having in a diameter smaller than the inner diameter of the orifice 32*a* pierces through the orifice 32*a*, and the refrigerant passes inside the orifice 32*a*. Also, an O-ring 36*g* is provided to the heat sensing shaft 36*f* in order to secure airtightness of the first passage 32 and the second passage 34.

A known diaphragm driving fluid is filled inside the upper pressure working chamber 36*b* of the pressure working housing 36*d*, and the heat of the refrigerant at the refrigerant exit of the evaporator 8 traveling inside the second passage 34 is transmitted to the diaphragm driving fluid through the diaphragm 36*a* and the valve means driving shaft 318 exposed to the second passage 34 or the equalizing hole 36*e* connected to the second passage 34.

The diaphragm driving liquid inside the upper pressure working chamber 36*b* turns into gas corresponding to the above-mentioned transmitted heat, and loads pressure to the upper surface of the diaphragm 36*a*. The diaphragm 36*a* is displaced vertically by the difference in the above-mentioned pressure of the diaphragm driving gas loaded to the upper surface and the pressure loaded to the lower side of the diaphragm 36*a*.

The vertical displacement of the central portion of the diaphragm 36*a* is transmitted to the valve means 32*b* through the valve means driving shaft, and moves the valve means 32*b* closer to or away from the valve seat of the orifice 32*a*. As a result, the flow rate of the refrigerant is controlled.

Namely, the temperature of the low-pressure vapor refrigerant at the exit side of the evaporator 8, that is, refrigerant exiting the evaporator, is transmitted to the upper pressure working chamber 36*b*, so that the pressure within the upper pressure working chamber 36*b* changes corresponding to the transmitted temperature, and the exit temperature of the evaporator 8 rises. When the heat load of the evaporator increases, the pressure within the upper pressure working chamber 86*b* increases, and the heat sensing shaft 36*f*, that is the valve means driving shaft, is driven downward moving the valve body 32*b* downwards, so that the opening of the orifice 32*a* increases. With such movement, the supply of refrigerant to the evaporator 8 increases, and lowers the temperature of the evaporator 8. On the contrary, when the temperature of the refrigerant exiting the evaporator 8 drops, that is, when the heat load of the evaporator decreases, the valve means 32*b* is driven in the opposite direction, decreasing the opening of the orifice 32*a*, decreasing the supply of the refrigerant to the evaporator, so that the temperature of the evaporator 8 rises.

In such conventional thermal expansion valve, the heat sensing shaft 36*f* is a member having relatively large diameter, and such member and the working shaft constitute the valve means driving shaft. However, there is a conventional thermal expansion valve constituting the above-mentioned valve means driving shaft with a rod member, and such conventional thermal expansion valve 10' using the rod member is shown in FIG. 28. The operation of the expansion valve shown in FIG. 28 is the same as the expansion valve shown in FIG. 26 or 27, and the same reference numbers with FIG. 26 or 27 indicate the same or equal portions.

A heat sensing portion 318 having a heat sensing mechanism operates as the heat sensing shaft 361*f*, comprising a large-diameter stopper 312 to the surface of which the diaphragm 36*a* contacts and acts as a receiving portion of the diaphragm 36*a*, a large-diameter portion 314 having one end surface adjoining the rear surface of the stopper 312 and having the central portion of the other end constituted as a projection 315 which is inserted slidably inside the lower pressure working chamber 36*c*, and a rodmember 316 of continuous integral composition with one end surface of which embedded to the interior of the projection 315 of the large-diameter portion 314 and the other end connected to the valve means 32*b* through a portion 371 corresponding to the working shaft. The heat sensing shaft 361*f* constituting the rod member 316 is exposed inside the second passage and the heat from the refrigerant vapor is transmitted thereto.

The rod member 361 which is a heat sensing shaft 361*f* is driven to move back and forth across the passage 34 corresponding to the displacement of the diaphragm 36*a* of the power element portion 36, so that a clearance connecting the passage 32 and the passage 34 is formed along the rod portion 316. In order to prevent formation of such clearance, an O-ring 42 fitted tightly to the outer circumference of the rod portion 316 is placed inside the large-diameter aperture 38' so that the O-ring exists between the passages. Moreover, in order to prevent the O-ring 42 from moving by the force operating in the longitudinal direction (the direction towards the power element portion 36) provided by the coil spring 32*d* and the refrigerant pressure of the passage 321, a push nut 41 as a self-locking nut is mounted to the rod portion 316, positioned inside the large-diameter aperture 38' and contacting the O-ring 42.

Such positioning and supporting structure of the conventional thermal expansion valve has been variously proposed. That is, a composition where an opening is provided on the division separating the engine room and the passenger room, and placing the thermal expansion valve to the passenger room side of the opening, connecting the refrigerant piping providing the refrigerant to the evaporator to the thermal expansion valve through a block-like connector, and supporting the above-mentioned connector through a packing material to the above-mentioned opening (for example, gazette of Japanese Patent Laid-Open 223427/95 and Japanese Utility Model Laid-Open 37729/95) has been proposed.

Also, a structure where the thermal expansion valve itself is supported to the opening through the packing material (for example, refer to the gazette of Japanese Patent Laid-Open 215047/95) has been proposed.

SUMMARY OF THE INVENTION

However, in such a supporting structure of the thermal expansion valve mentioned above, it is uneconomical in view of component cost and assembly cost to use the connector and the packing. Also, in the case where the thermal expansion valve is supported directly through the packing material, there is a problem that a clearance may be formed between the inner wall of said opening and the thermal expansion valve resulting in insufficient sealing. Moreover, in a conventional thermal expansion valve, the shape for supporting the thermal expansion valve of the air conditioner of an automobile to the opening of said division has never been considered. That is, the upper lid constituting the power element portion of the thermal expansion valve is formed as a dome provided with a cork body projecting from the wall portion of the upper lid so that ability to fit tightly with said inner wall of the opening becomes a problem, and the outer shape of the power element portion has not been considered.

Therefore, the present invention aims at providing a thermal expansion valve that could be tightly fixed to the opening provided to the division dividing the engine room and the passenger room, providing a secure seal.

In order to achieve the above-mentioned object, the thermal expansion valve of the present invention is comprised of a valve body, a power element portion provided to the upper end portion of said valve body which drives a valve means according to the displacement of a diaphragm, and an adjust screw provided to the lower end portion of said valve body which adjusts the pressurizing force of a spring controlling the valve opening of said valve means, wherein said power element portion is provided with a cover embracing the same, and the lower portion of said valve body is formed as a tapered surface.

Also, the thermal expansion valve of the present invention is comprised of a valve body equipped with a first passage through which refrigerant entering an evaporator travels and a second passage through which refrigerant exiting from said evaporator travels, the opening of a valve being controlled both by a valve means arranged opposing an orifice formed partway of said first passage and being biased toward the valve closing direction with a spring, and by a power element operated by sensing the temperature of said refrigerant traveling through said second passage and forcing said valve means toward the valve opening direction through a rod, wherein said power element is provided with a cover embracing the same, and the lower portion of said valve body provided with said spring is formed as a tapered surface.

Moreover, as a preferable embodiment of the thermal expansion valve of the present invention, the cover includes an interior formed with a concave portion and an exterior formed with curvature surfaces and tapered surfaces continuing therefrom, said concave portion storing the power element therein, and said tapered surfaces being substantially continued from the tapered surfaces of said valve body.

Further, as an embodiment of the thermal expansion valve of the present invention, the tapered surfaces of said valve body are formed from substantially the middle of the total height of said valve body.

Also, as an embodiment of the thermal expansion valve of the present invention, the valve body is formed to have an outer shape comprising mutually parallel surfaces starting from the upper surface provided with said power element portion and extended to approximately the middle of the total height of said valve body, and tapered surfaces continued therefrom which is tapered toward a bottom surface provided with an adjust screw.

According to the present invention being formed as explained above, the valve body is formed with parallel surfaces and tapered surfaces, enabling the valve body to fit tightly to the above-mentioned division wall, and improving the fixing capability.

Moreover, it could change the outer shape of the power element portion with the cover provided to the power element portion, and the fitting with the opening of the above-mentioned division wall is improved, and also the sealing ability is improved.

DETAILED DESCRIPTION OF PREFERRED EMBODIMENTS

Figure 1:
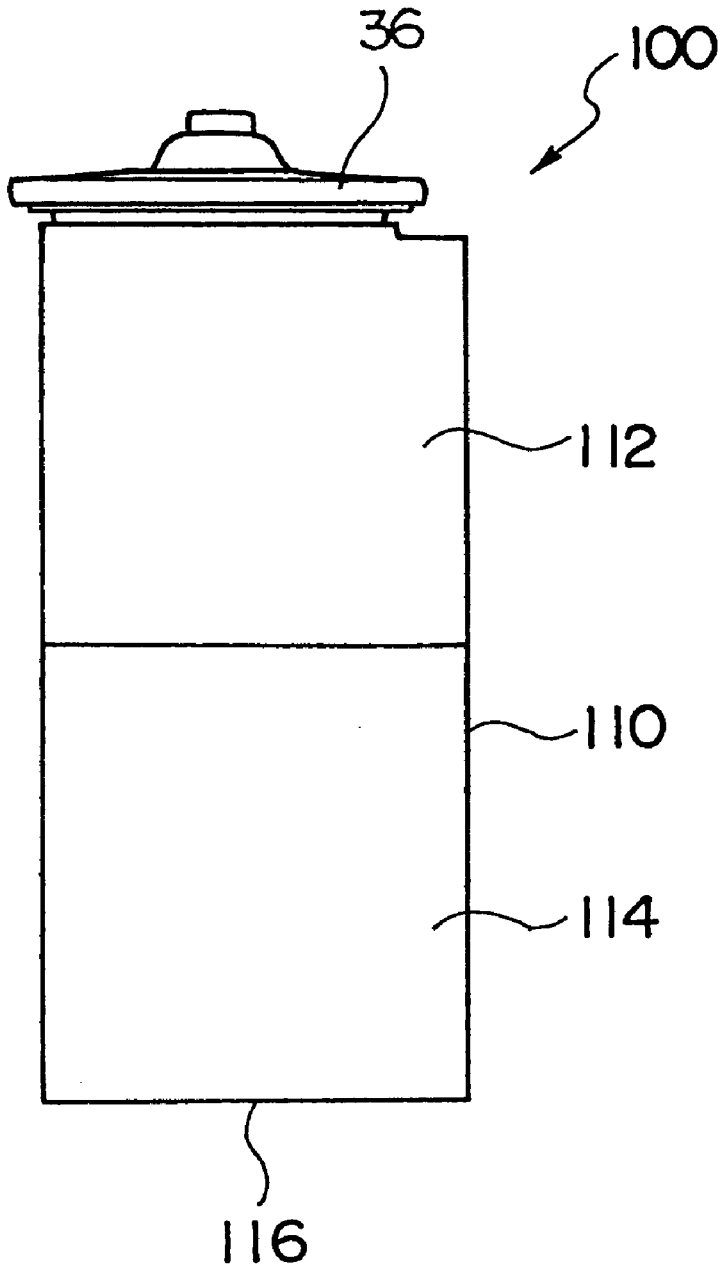
FIG. 1 is a front view of the thermal expansion valve of the present invention.
Figure 2:
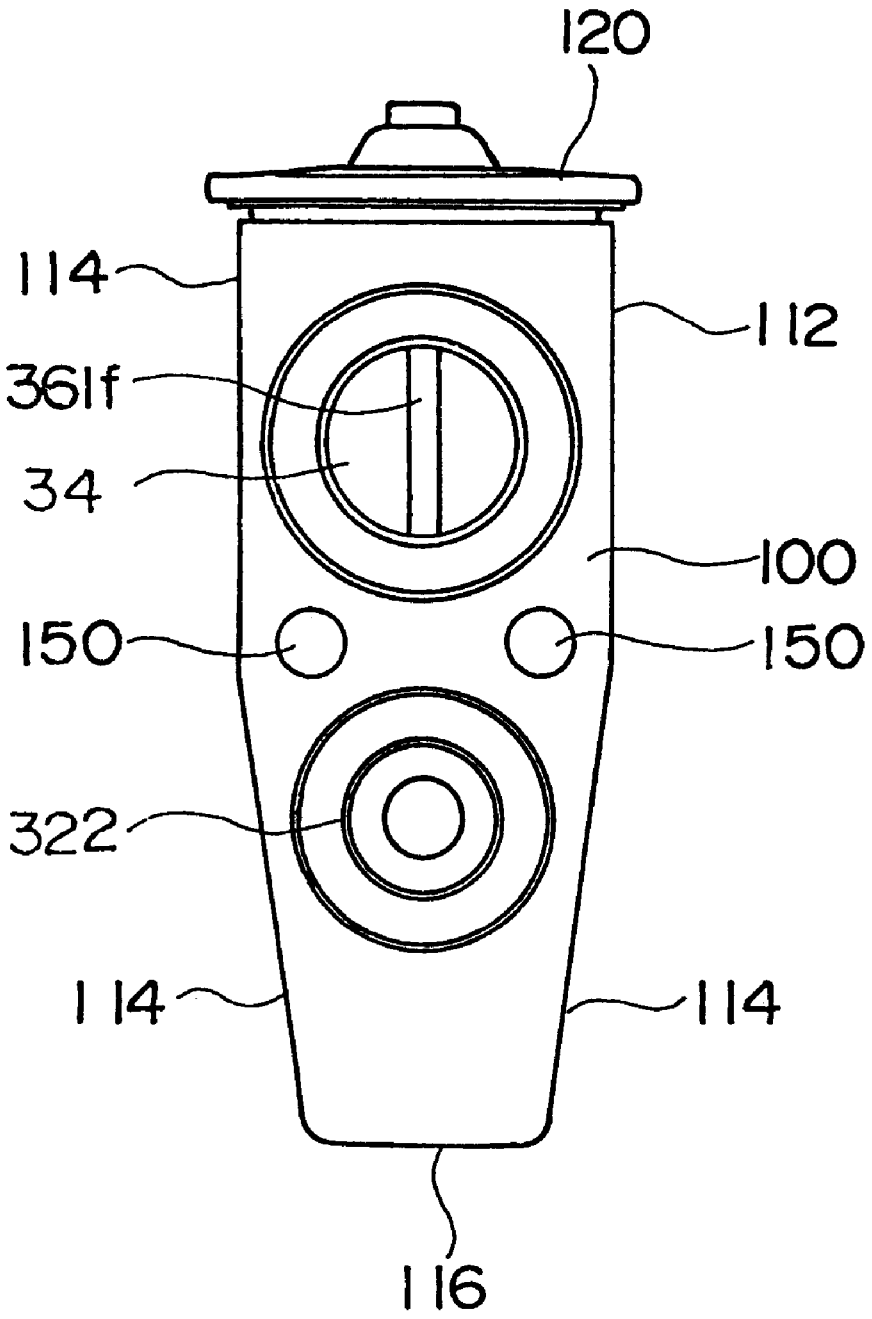
FIG. 2 is a left side view of the thermal expansion valve of the present invention.
Figure 3:
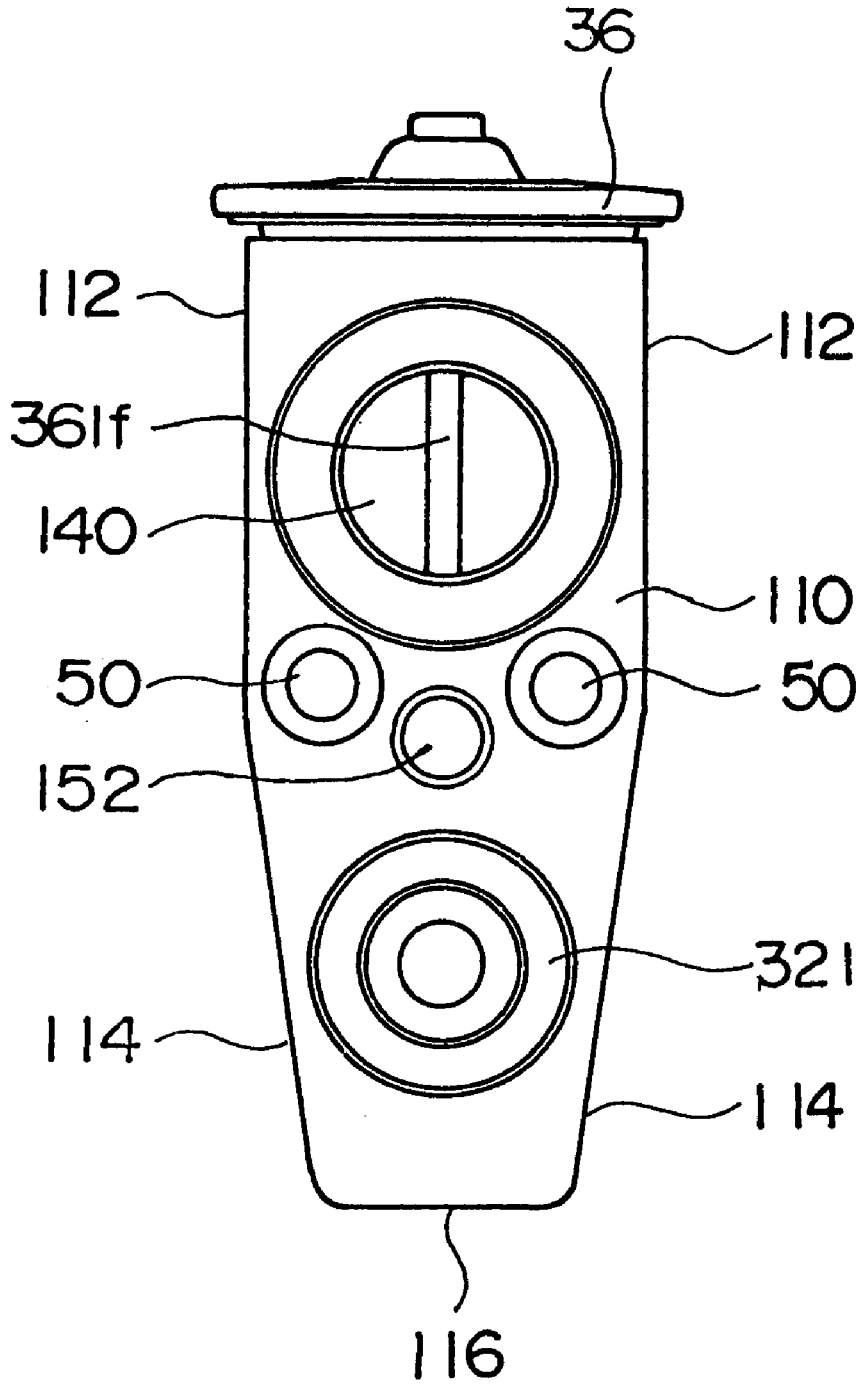
FIG. 3 is a right side view of the thermal expansion valve of the present invention.
Figure 4:
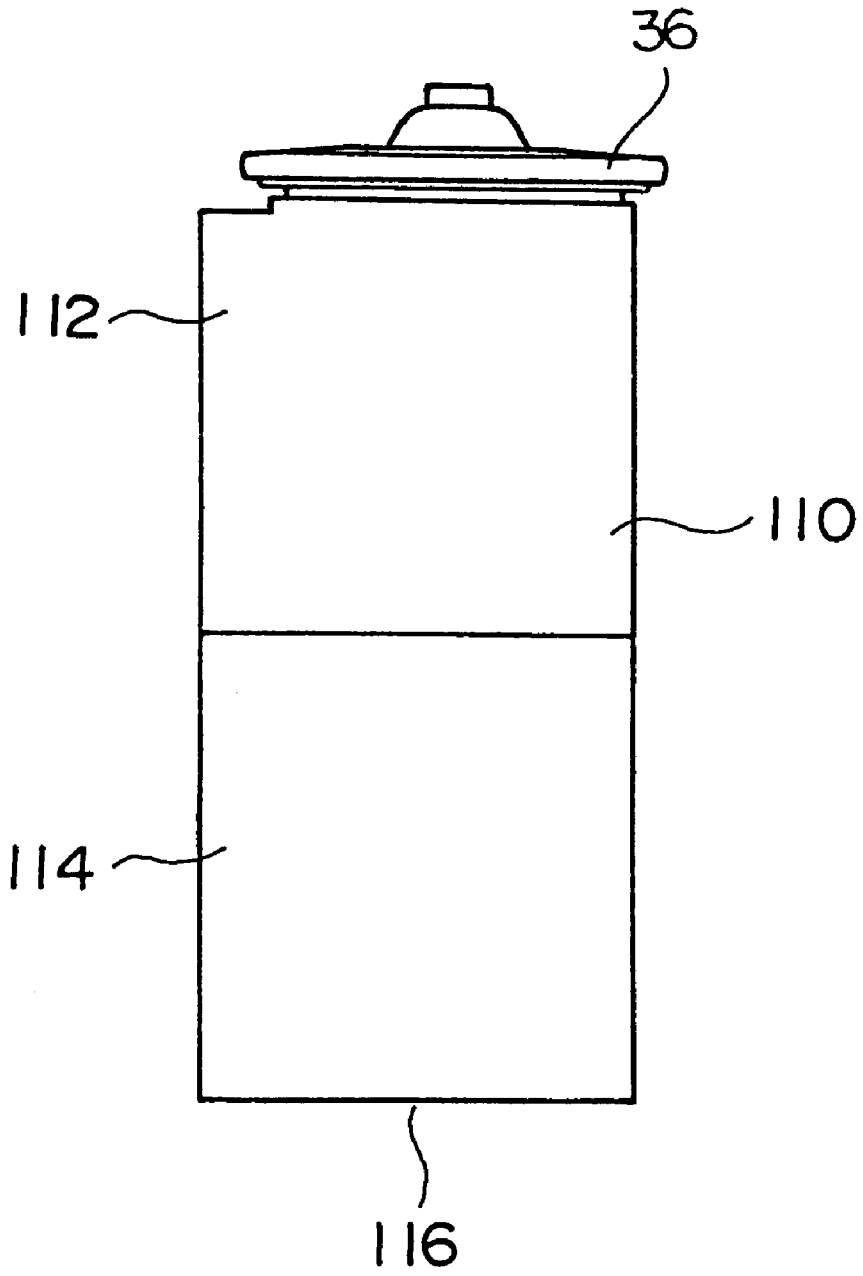
FIG. 4 is a rear view of the thermal expansion valve of the present invention.
Figure 5:
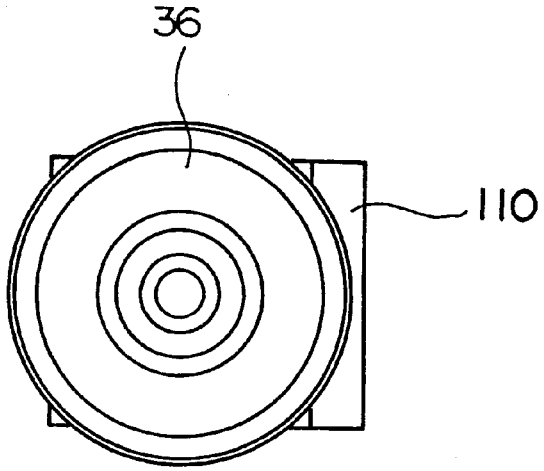
FIG. 5 is a top view of the thermal expansion valve of the present invention.
Figure 6:
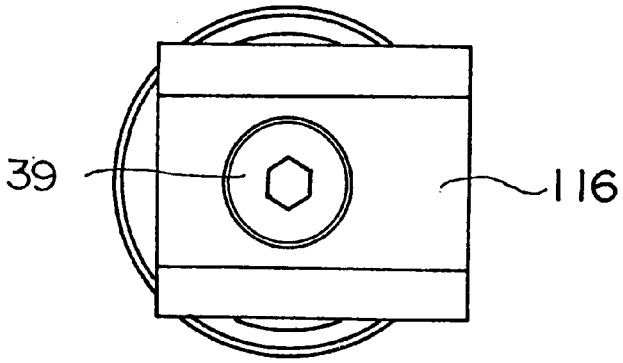
FIG. 6 is a bottom view of the thermal expansion valve of the present invention.

FIGS. 1 through 6 are drawings indicating one embodiment of the thermal expansion valve of the present invention, in which FIG. 1 is a front view, FIG. 2 is a left side view, FIG. 3 is a right side view, FIG. 4 is a rear view, FIG. 5 is a top view, and FIG. 6 is a bottom view.

The present invention provides the identical function as the conventional thermal expansion valve, and differs from the conventional thermal expansion valve only in the outer shape of the valve body. Therefore, the same reference numbers will be provided to the identical portions, and explanations on portions explained in the explanation of conventional valve are omitted.

The thermal expansion valve shown as a whole by reference number 100 has a valve body 110 made from aluminum alloy and the like. A power element portion 36 explained above is mounted to the peak portion of the valve body 110, and the diaphragm inside the power element portion 36 operates a heat sensing shaft 361*f*.

To one side near a bottom 116 of the valve body 110 is provided an entrance port 321 of a first passage 32 of the refrigerant supplied through a condenser and a receiver. The refrigerant thus introduced travels to an evaporator from an exit port 322 provided to the other side of the valve body through an orifice, the opening of which is adjusted by the heat sensing shaft 361*f*.

The refrigerant exiting the evaporator travels through a second passage 34 provided to a power element portion 36 side of the valve body 110. During the course, the temperature of the refrigerant is transmitted to the diaphragm through the heat sensing shaft 361*f*.

The valve body 110 is provided with two perforation holes 50 in parallel to the axis of the second passage 34. The perforation holes are used to pierce rods and the like to fasten the body to other members. Also, to the other side of the valve body 110, a screw hole 152 is provided with a bottom in parallel to the perforation hole 50, and a screwing bolt and the like is screwed thereto.

Sides 112 in parallel to the axis of a refrigerant passage 140 of the valve body 110 are construed of surfaces in parallel with each other from the top surface mounted with the power element portion 36 towards the bottom surface 116 until approximately the middle of the total height of the valve body 110. From the middle of the body to the bottom surface 116, the sides are formed as tapered surfaces 114 continuing from the parallel surfaces.

To the bottom surface 116 of the valve body 110 is mounted a nut member 39 for sealing the valve chamber explained before.

With the thermal expansion valve of the present invention, the valve body is comprised of parallel surfaces and tapered surfaces continuing from the parallel surfaces, so that it is easily fitted tightly to the division mentioned above, and the mounting ability is improved.

Next, an embodiment of the present invention where the thermal expansion valve of the present invention is mounted to said division will be explained.

Figure 7:
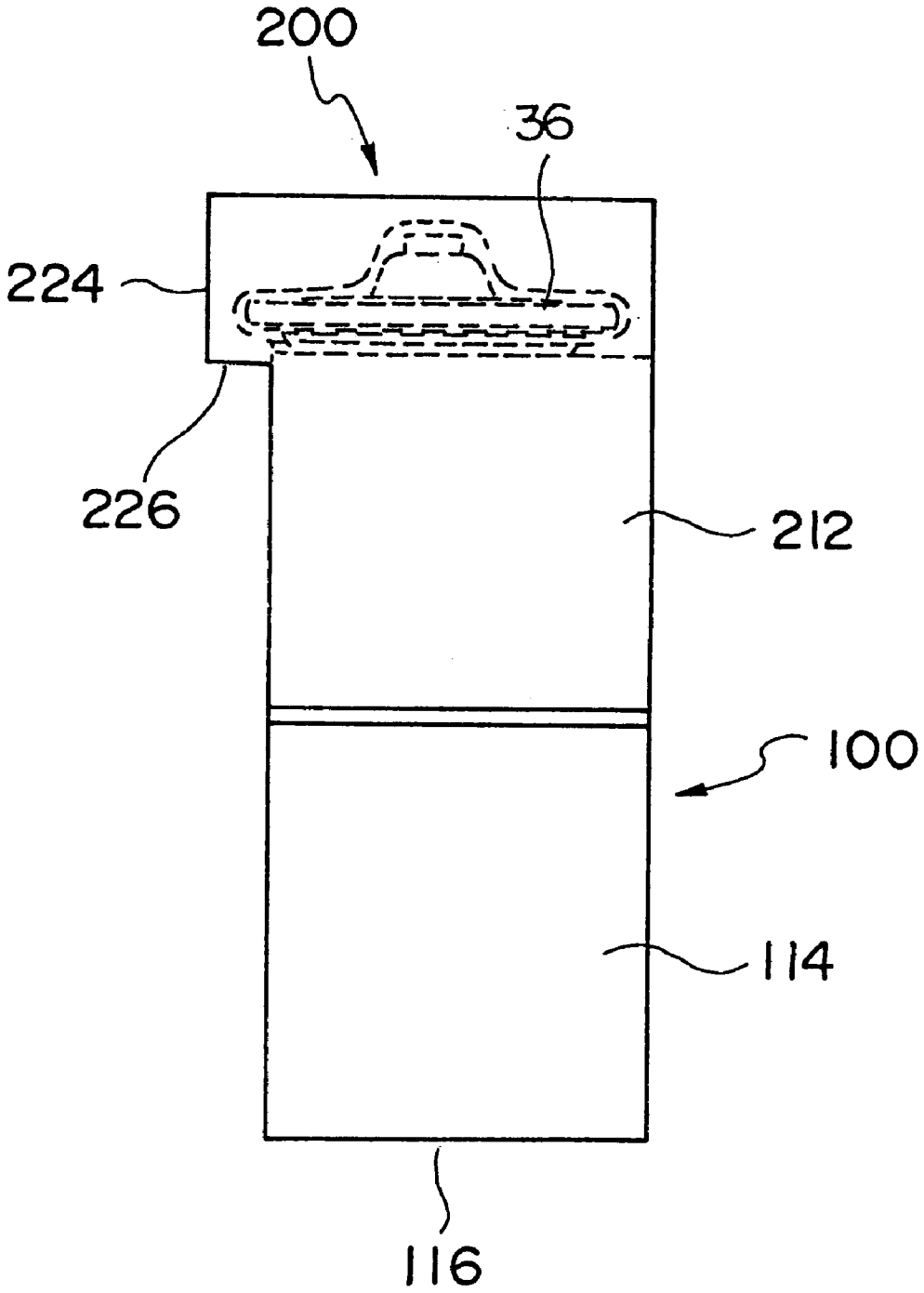
FIG. 7 is a front view of the thermal expansion valve with a cover.
Figure 8:
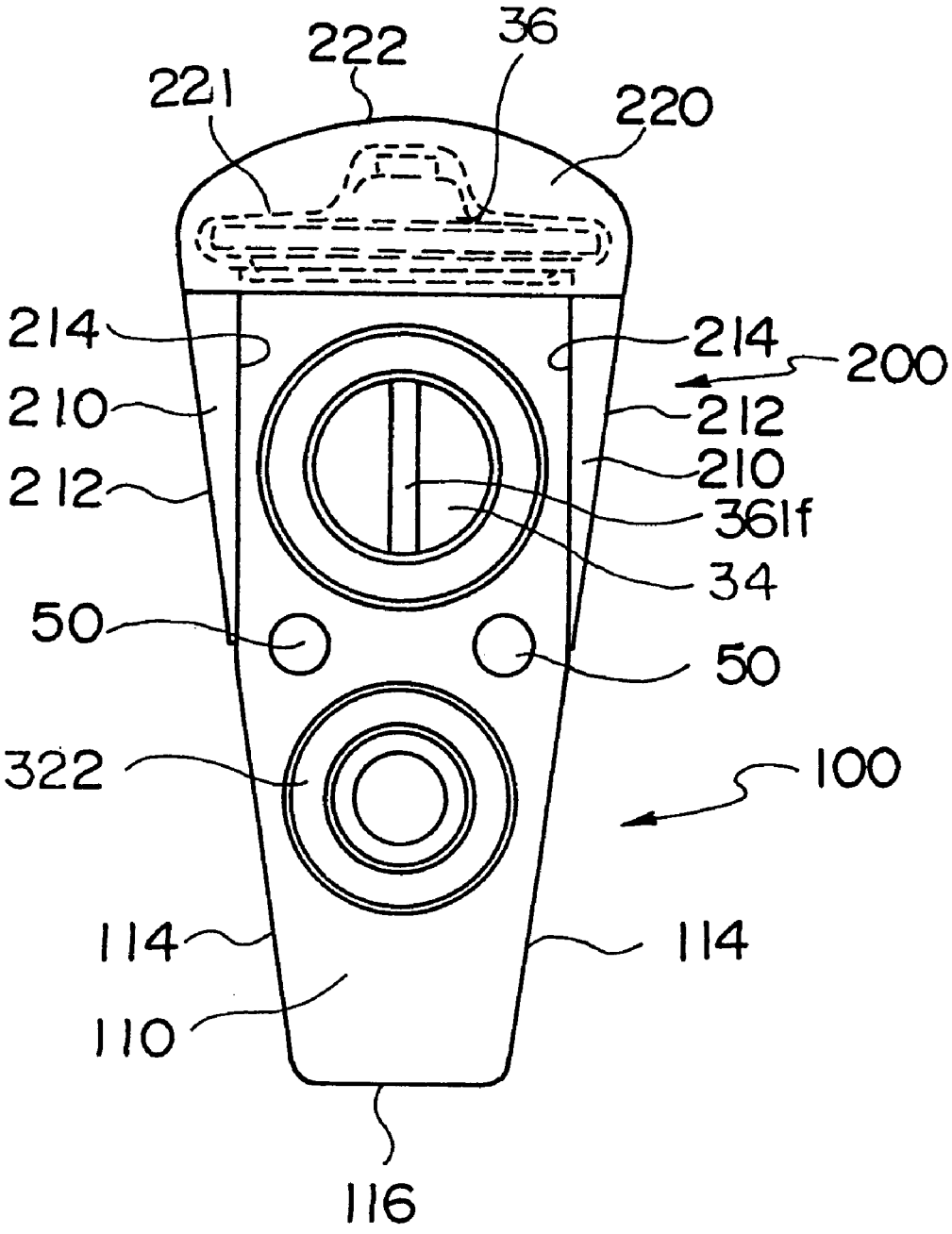
FIG. 8 is a left side view of the thermal expansion valve with a cover.
Figure 9:
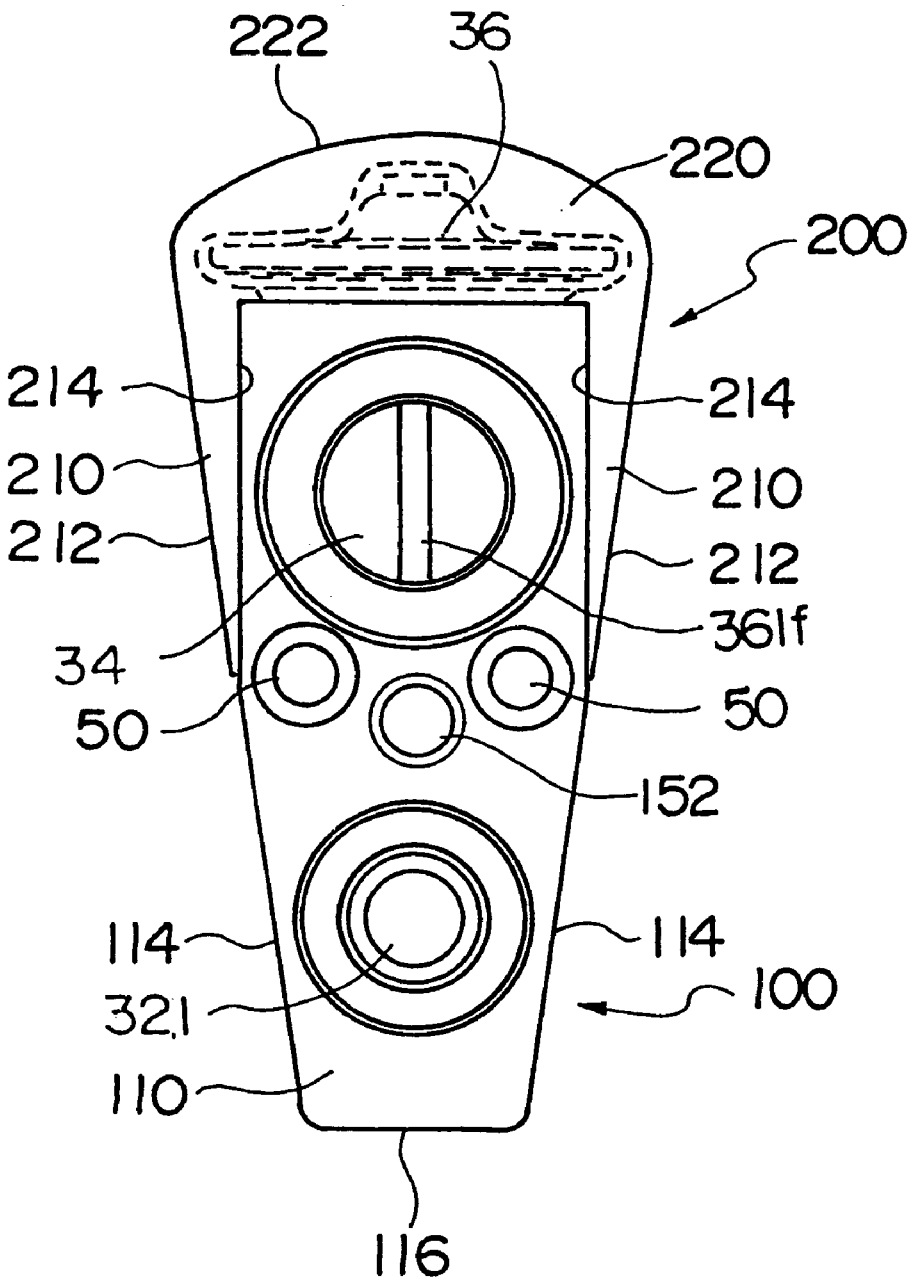
FIG. 9 is a right side view of the thermal expansion valve with a cover.
Figure 10:
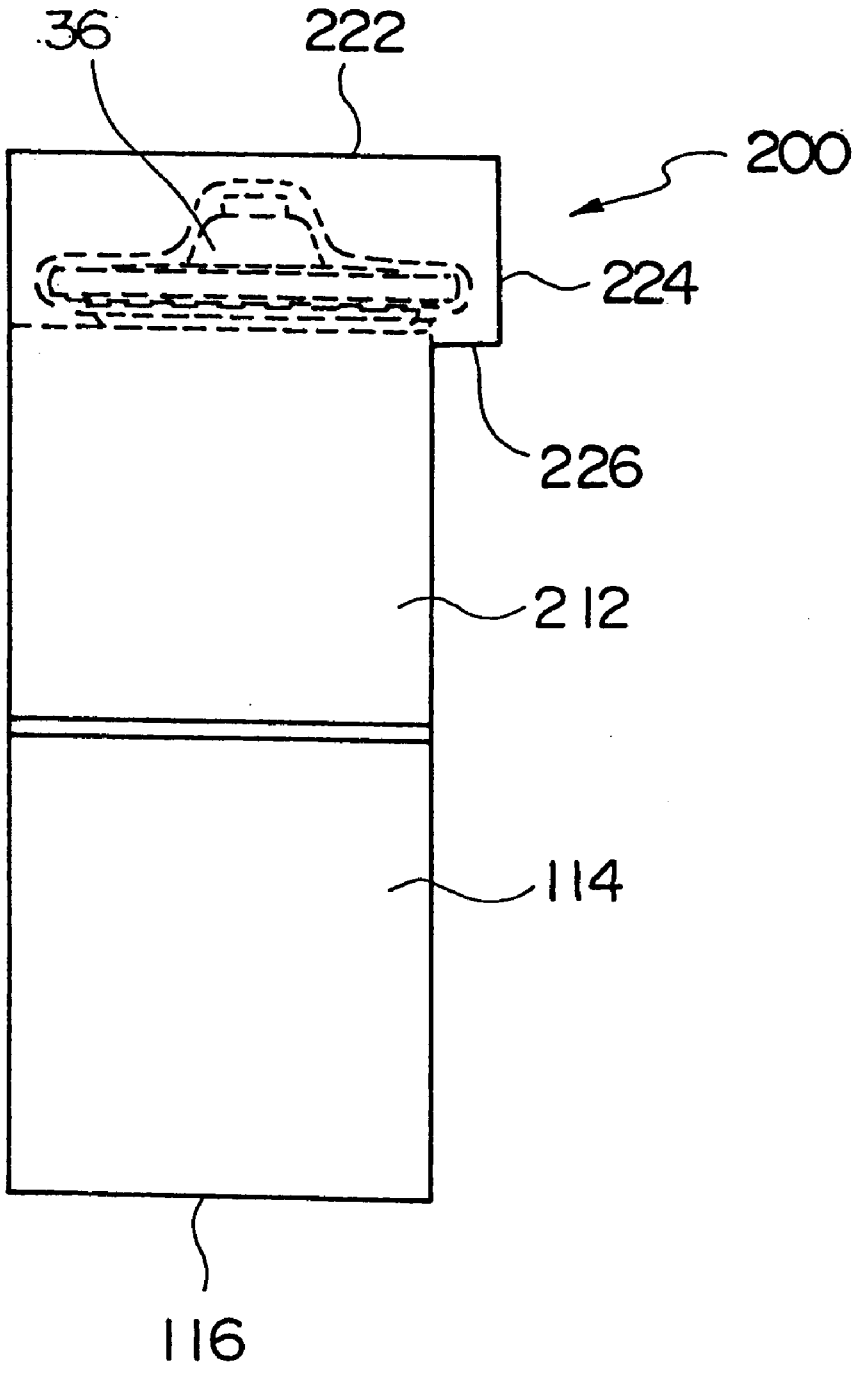
FIG. 10 is a rear view of the thermal expansion valve with a cover.
Figure 11:
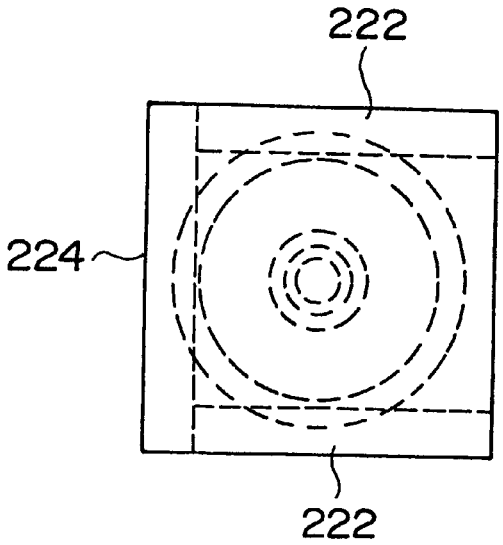
FIG. 11 is a top view of the thermal expansion valve with a cover.
Figure 12:
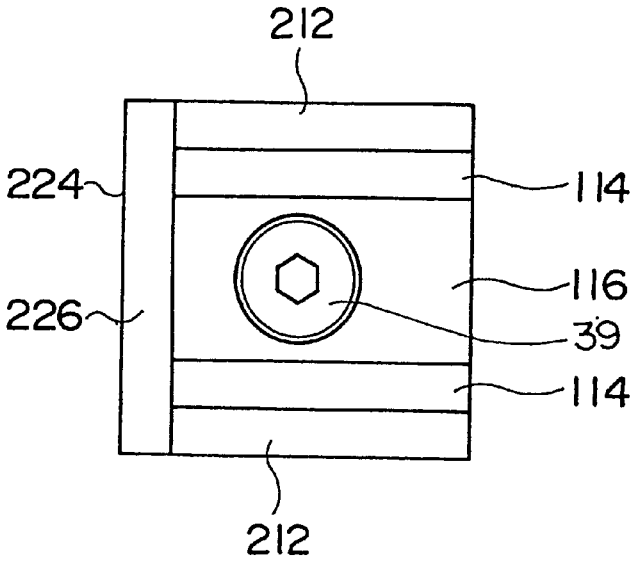
FIG. 12 is a bottom view of the thermal expansion valve with a cover.

FIG. 7 is a front view of the thermal expansion valve indicating the state where the cover is mounted to the outer side of the valve body of the thermal expansion valve shown in the embodiment of FIGS. 1 through 6, FIG. 8 is a left side view, FIG. 9 is a right side view, FIG. 10 is a rear view, FIG. 11 is a top view, and FIG. 12 is a bottom view, each corresponding to FIGS. 1 through 6.

A cover shown as a whole by reference number 200 in the figure is formed from plastic resin and the like.

The cover 200 is provided with a head portion 220 having a concave portion 221 formed therein for storing the power element portion 36, and a tapered portion 210 covering the outer side of the parallel sides of the thermal expansion valve 110. The concave portion 221 stores the power element portion 36, and contacts the outer peripheral of the power element portion 36. Therefore, with the cover 200, the outer shape of the power element portion 36 is adjusted. Outer sides 212 of the tapered portion 210 are formed as tapered surfaces forming approximately identical planes with the tapered surfaces 114 of the valve body 110 of the thermal expansion valve. Inner sides 214 of the tapered portion 210 are embedded to the parallel surface of the valve body 110.

Outer surfaces 222 of the head portion 220 of the cover 200 are composed of curved surfaces.

Therefore, the thermal expansion valve mounted with the cover 200 has the side shape as is indicated in FIGS. 8 and 9.

Also, end surface 224 of the head portion 220 as seen from the front projects from the expansion valve body, and covers the entire power element portion 36. The end surface 224 contacts with the expansion valve body with surface 226 orthogonal to the end surface 224. As seen from above, the thermal expansion valve of the present invention is construed so as to have an outer shape formed from outer surfaces of the curved surfaces and the tapered surfaces, and the fitting of the thermal expansion valve and the mounting portion is improved.

Figure 13:
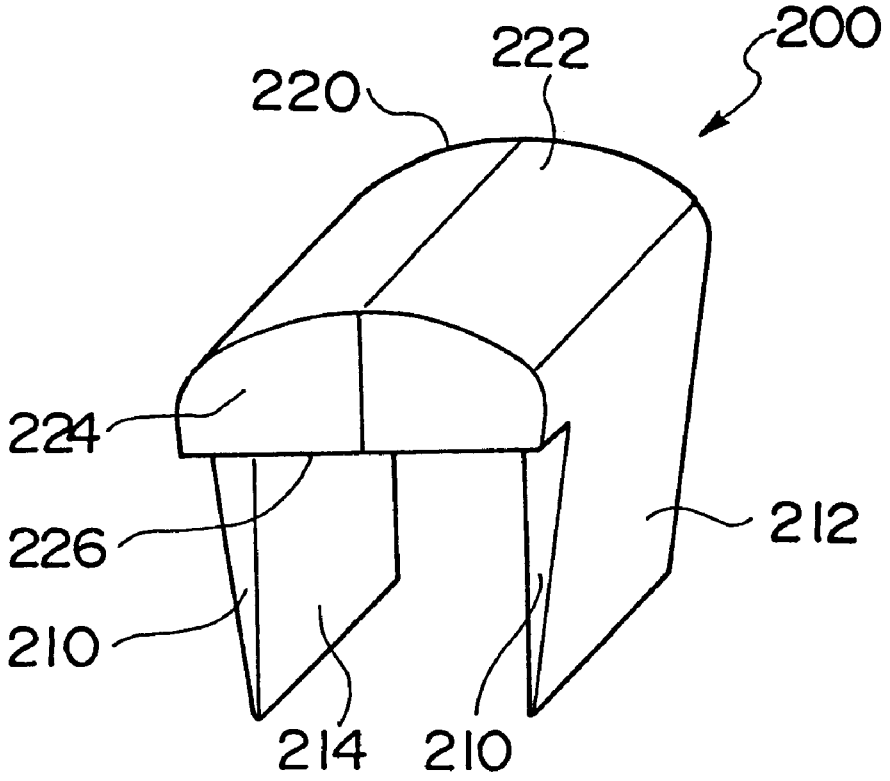
FIG. 13 is a perspective view of the cover of the thermal expansion valve.

FIG. 13 is a cross-sectional view of the cover 200. The cover 200 is, for example divided into two parts, and is mounted to the thermal expansion valve. The divided surfaces are fixed with proper methods such as adhesive or fastener and the like. With the cover 200, the power element is inserted to its concave portion and the outer peripheral of the power element is contacted thereto, so the sealing ability of the cover and the thermal expansion valve is improved, and also the mounting ability is improved.

Figure 14:
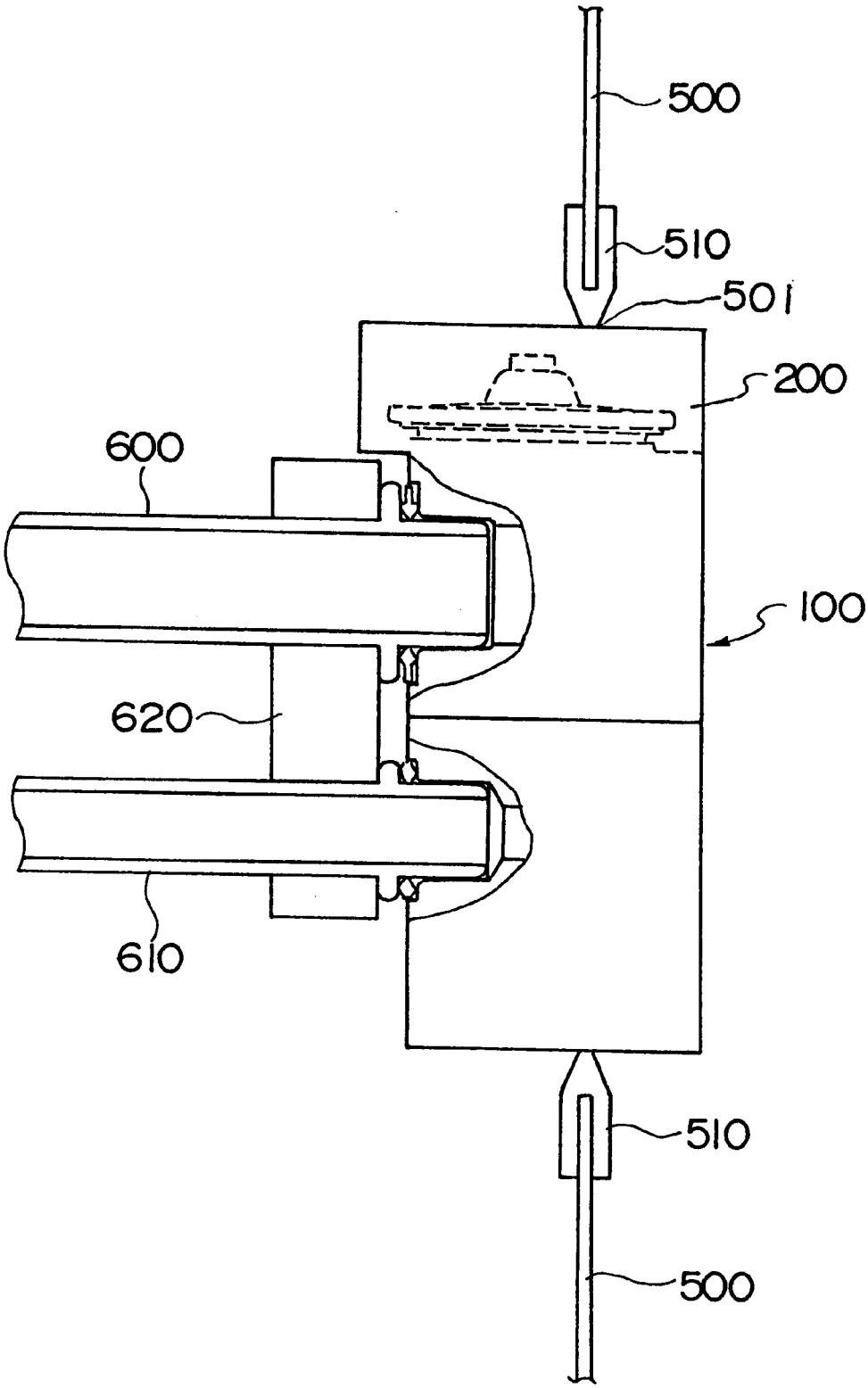
FIG. 14 is a side view showing the mounted state of the thermal expansion valve of the present invention.
Figure 15:
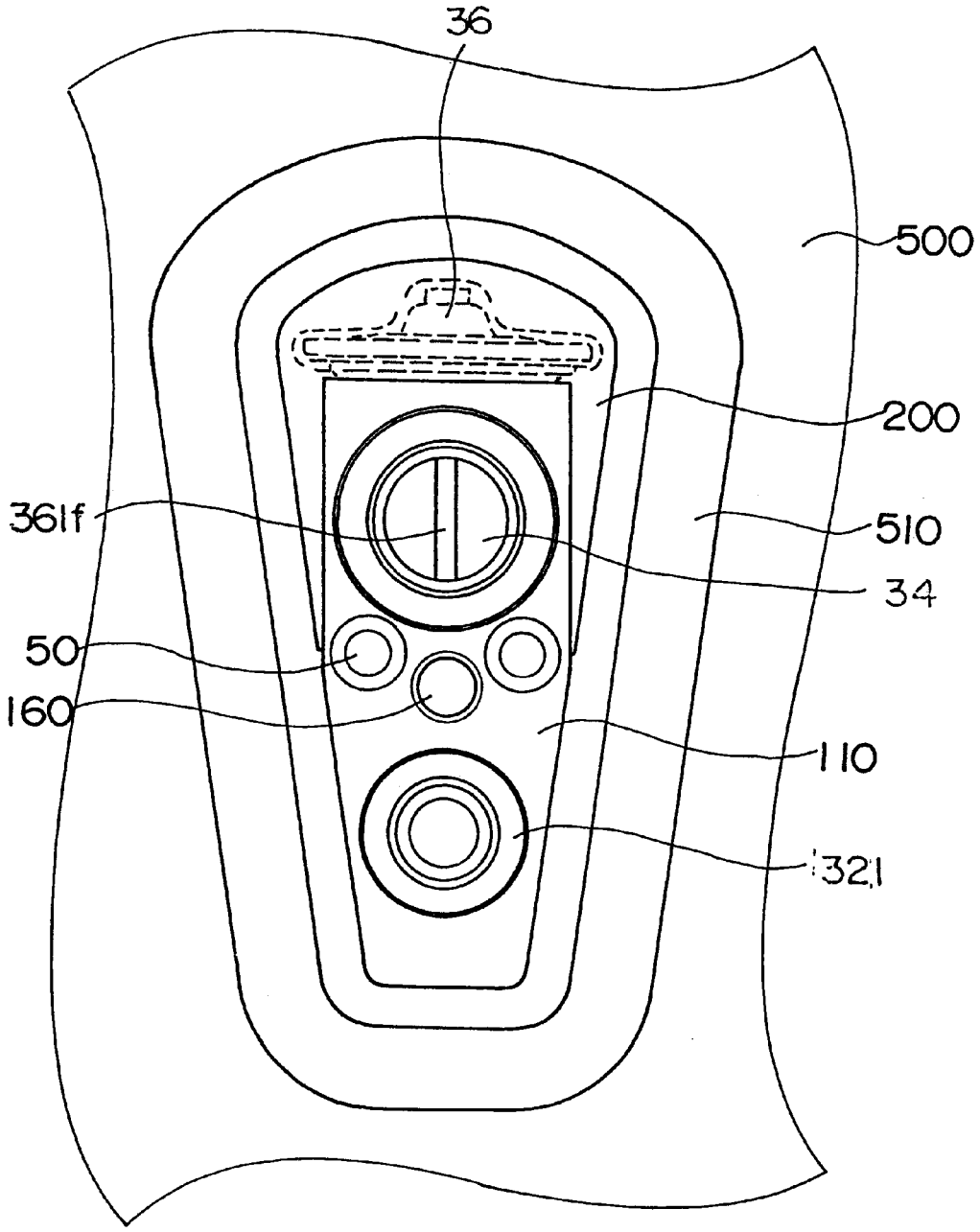
FIG. 15 is a front view showing the mounted state of the thermal expansion valve of the present invention.

FIG. 14 is a side view showing the condition where the thermal expansion valve of the present invention is mounted, for example, to an opening 501 formed at a division 500 dividing the engine room and the passenger room of an automobile, and FIG. 15 is a front view.

The thermal expansion valve 100 with the cover 200 is held to the opening 501 which is the mounting portion formed to the division 500 made from metal board through a seal member 510 which is a packing member. Pipings 600, 610 of the refrigerant are connected to the body of the thermal expansion valve with brackets 620.

The front shape of the thermal expansion valve mounted with the cover 200 has a shape substantially covered with the tapered surfaces and the curved surfaces, so that fitting of the seal member 510 to the opening which is a mounting portion is improved, and the opening is sealed effectively.

Therefore, the engine room and the passenger room are sealed completely.

The above explanations were given regarding cases where the cover 400 is divided and mounted to the thermal expansion valve 100. However, the present invention is not limited to such case, and could be applied to cases where the cover formed as a single body from plastic resin and the like is mounted to the thermal expansion valve.

FIGS. 16 through 23 show another embodiment of the present invention for such case, wherein the composition of the thermal expansion valve is the same as that shown in FIGS. 1 through 6, and so identical portions are provided with identical reference numbers and explanations thereof are omitted.

Figure 16:
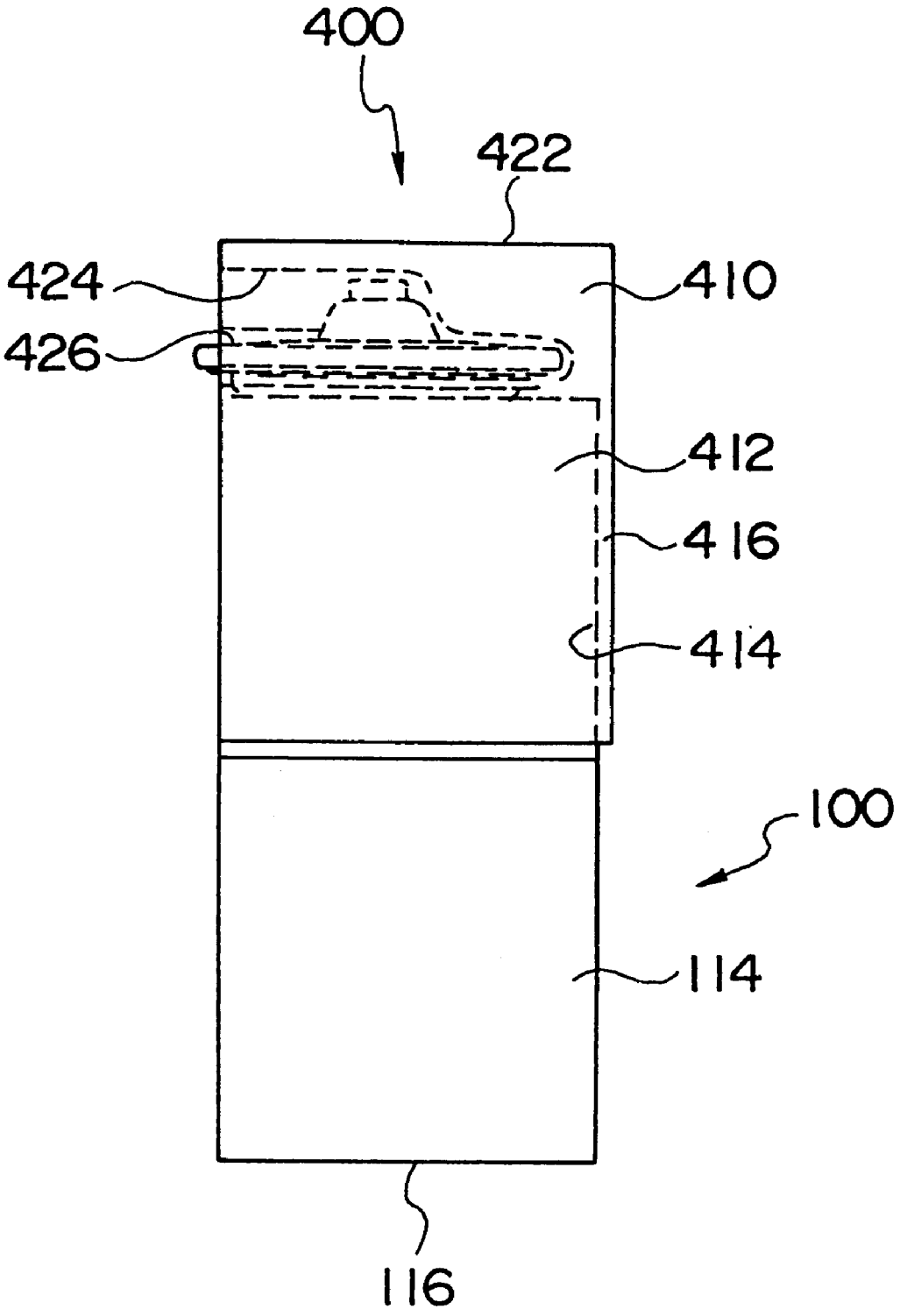
FIG. 16 is a front view of the thermal expansion valve of another embodiment of the present invention.
Figure 17:
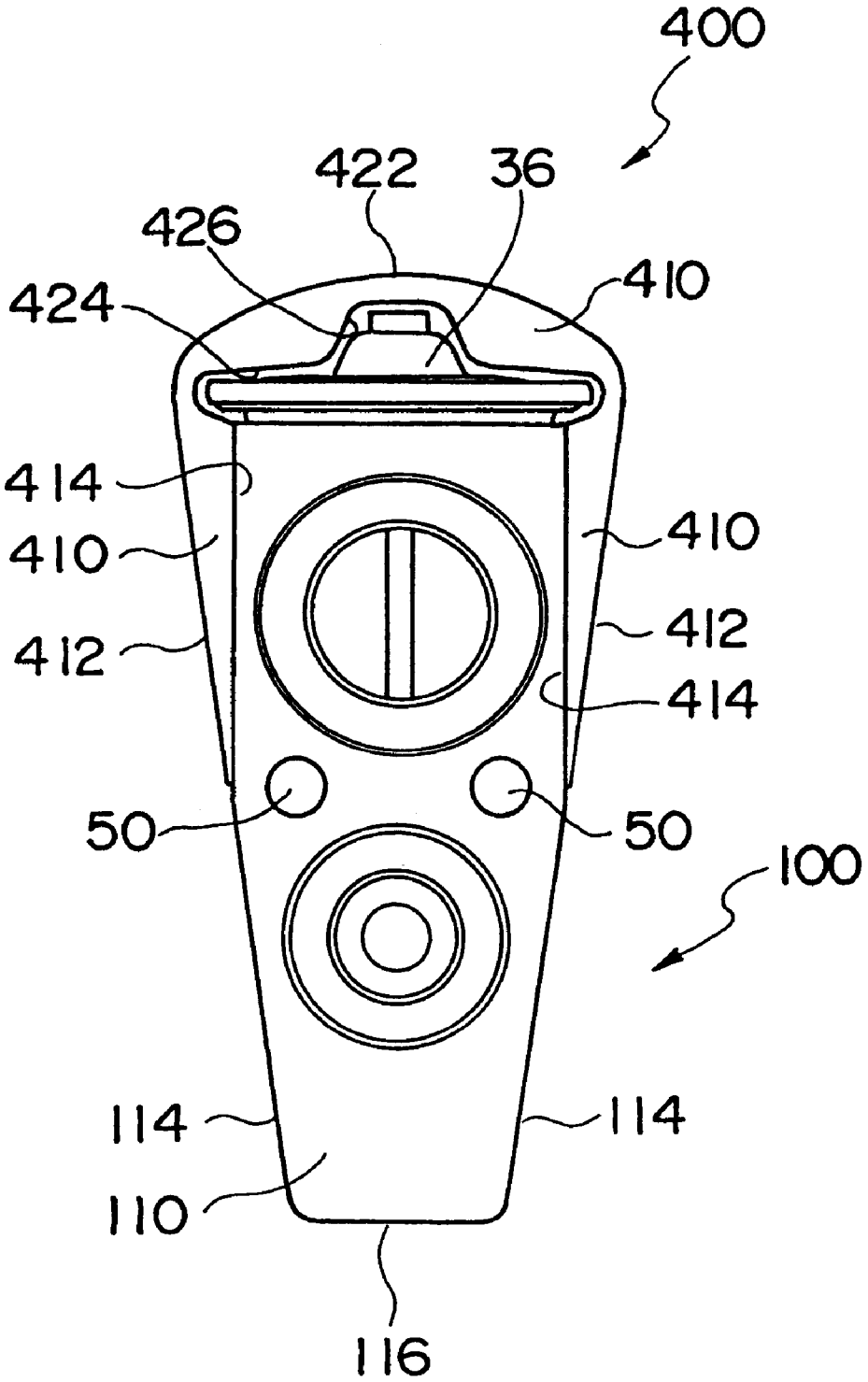
FIG. 17 is a left side view of the thermal expansion valve of another embodiment of the present invention.
Figure 18:
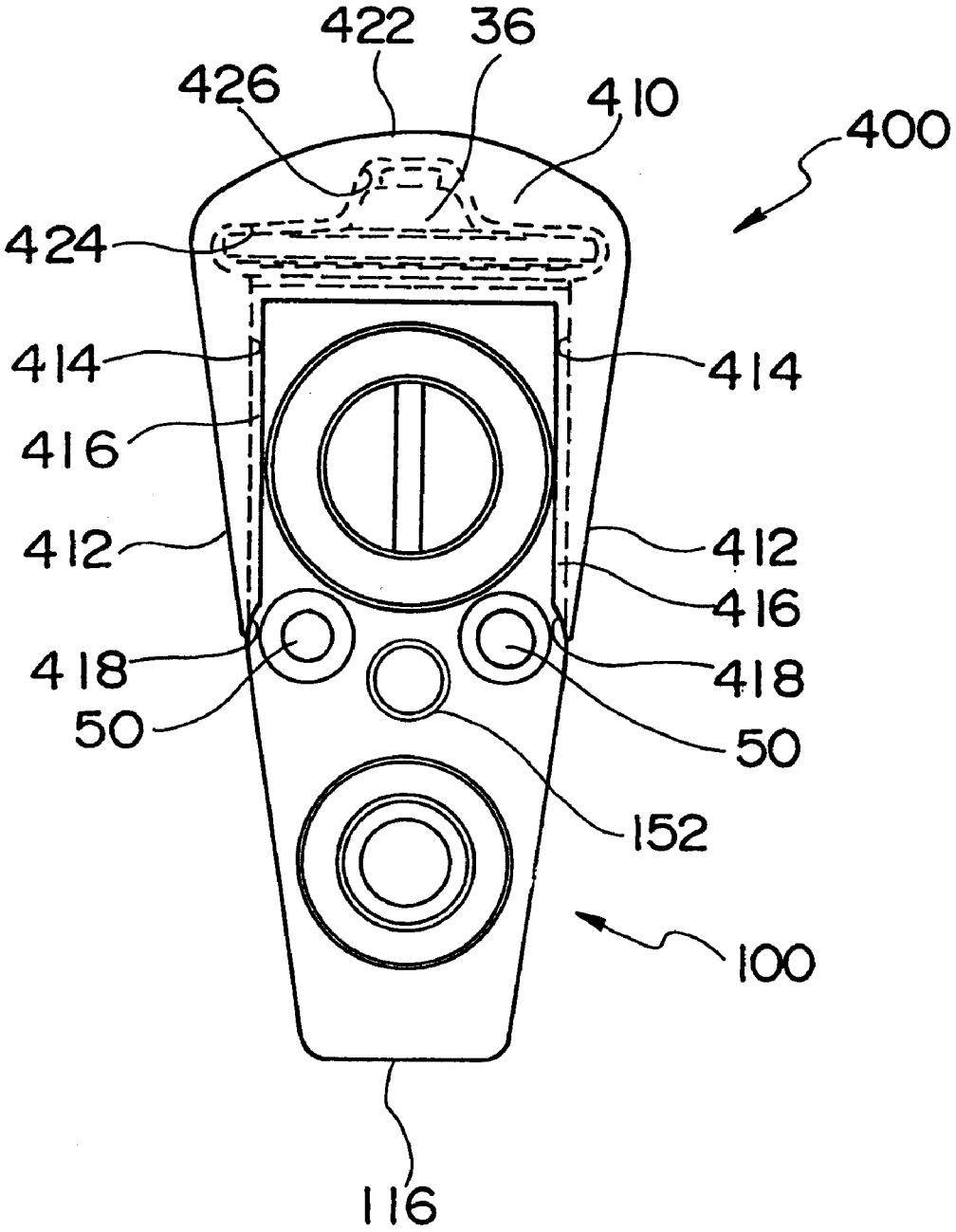
FIG. 18 is a right side view of the thermal expansion valve of another embodiment of the present invention.
Figure 19:
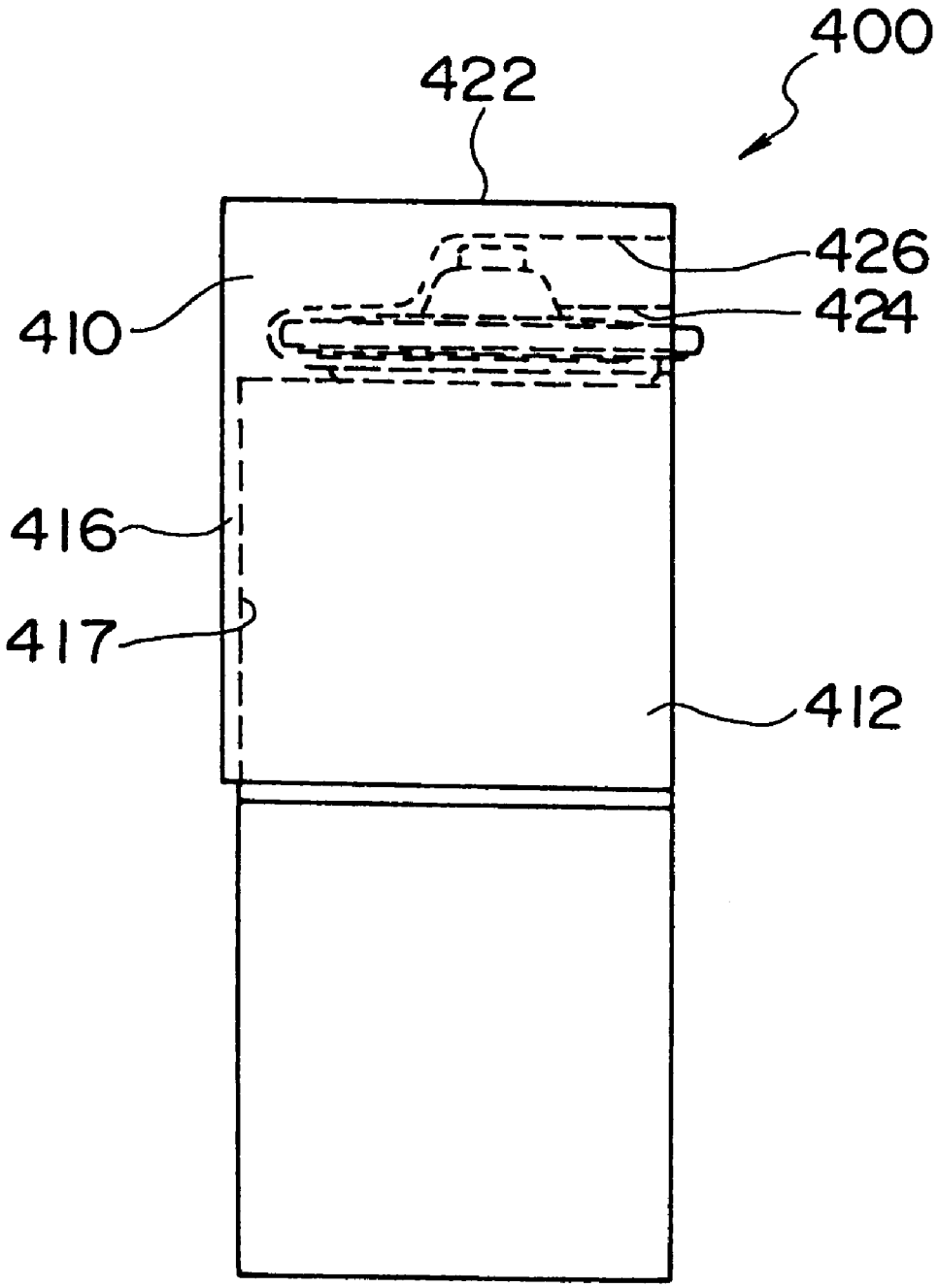
FIG. 19 is a rear view of the thermal expansion valve of another embodiment of the present invention.
Figure 20:
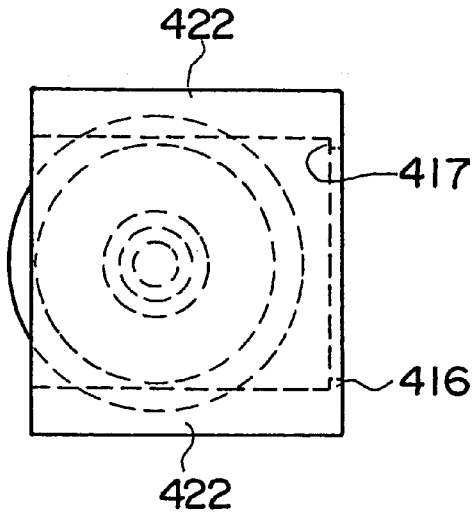
FIG. 20 is a top view of the thermal expansion valve of another embodiment of the present invention.
Figure 21:
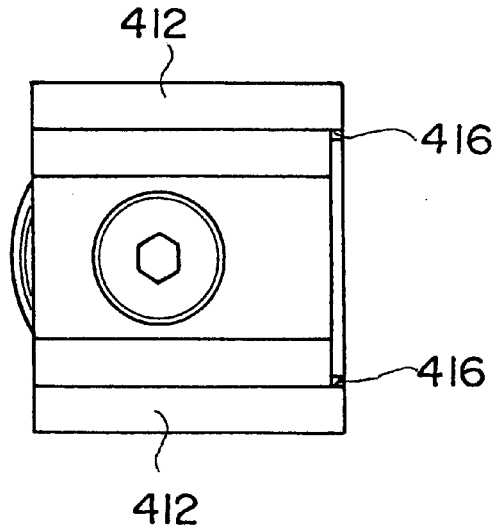
FIG. 21 is a bottom view of the thermal expansion valve of another embodiment of the present invention.
Figure 22:
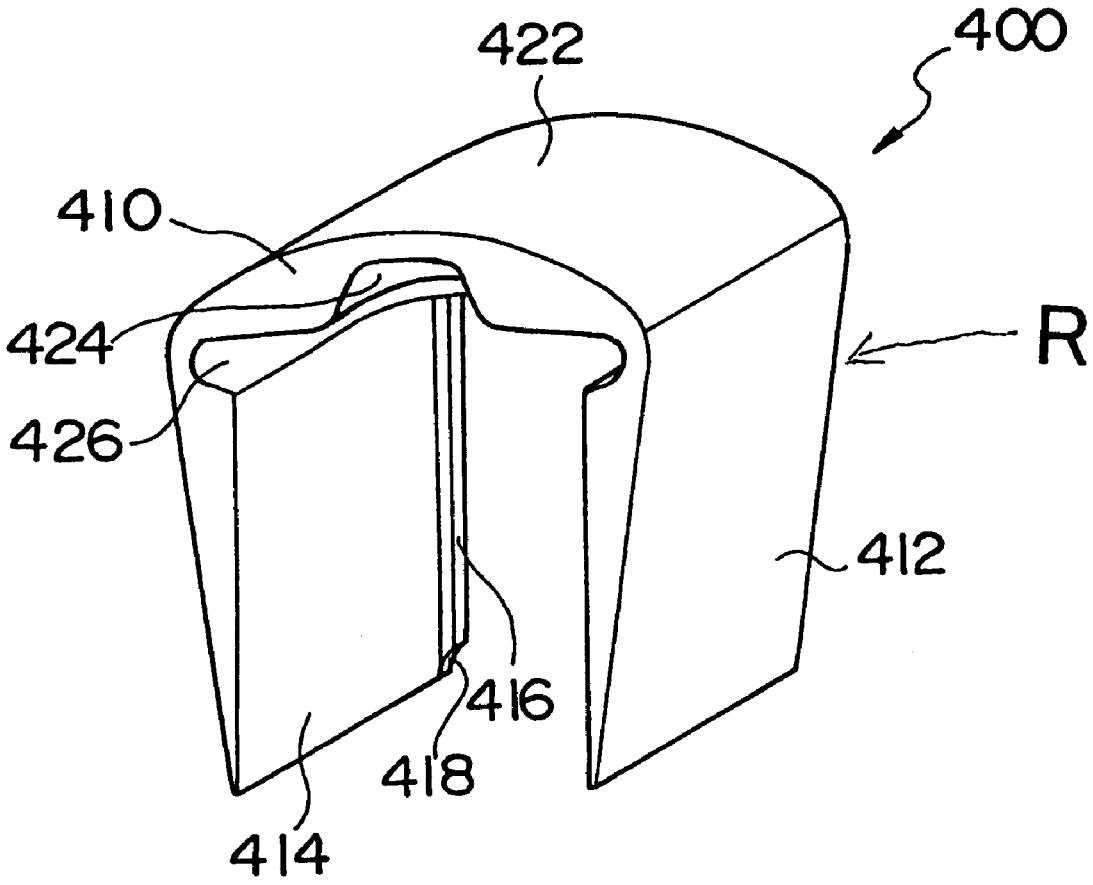
FIG. 22 is a perspective view of the cover of the thermal expansion valve.
Figure 23:
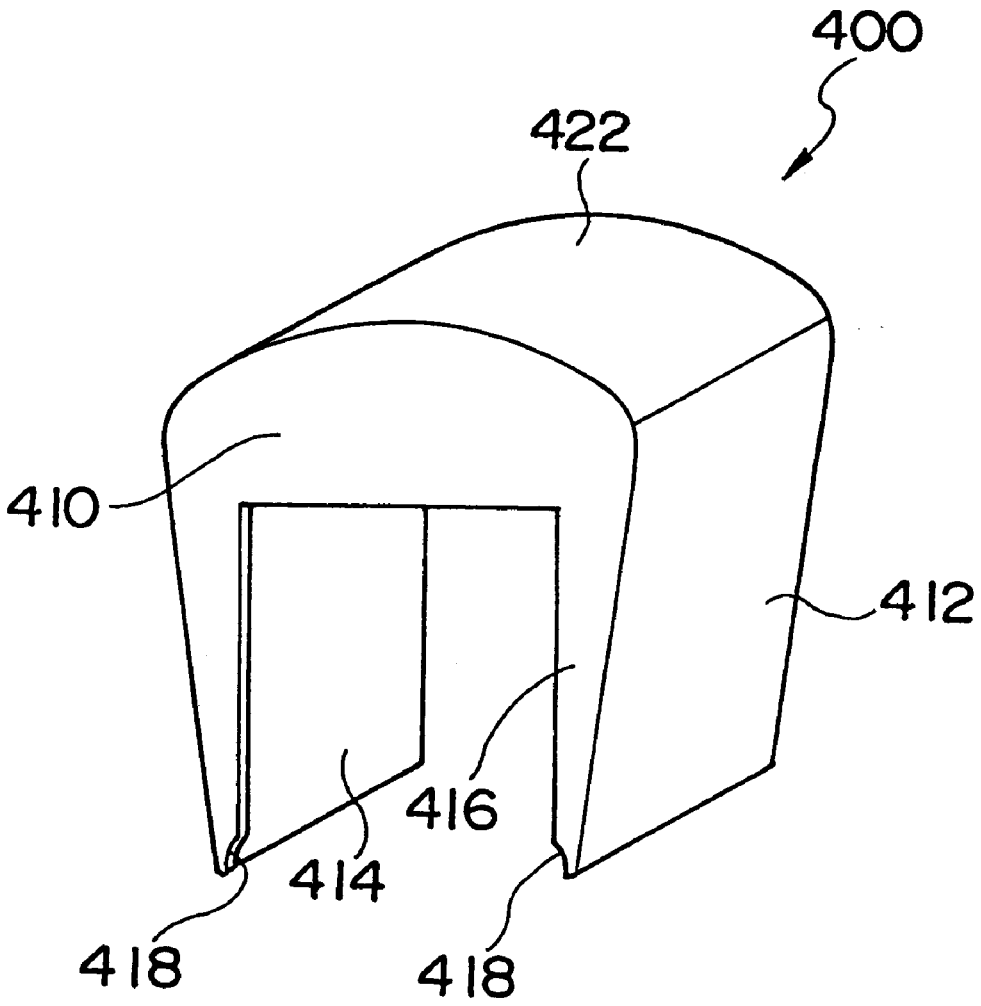
FIG. 23 is a perspective view of the cover of the thermal expansion valve.

That is, FIG. 16 is a front view of the thermal expansion valve showing the embodiment where the cover is mounted to the thermal expansion valve 100, FIG. 17 is a left side view, FIG. 18 is a right side view, FIG. 19 is a rear view, FIG. 20 is a top view, FIG. 21 is a bottom view, FIG. 22 is a perspective view of the cover, and FIG. 23 is a perspective view of the cover observed from the direction of arrow R in FIG. 22.

In the figures, the cover indicated as a whole by reference number 400 is formed as a single body from plastic resin and the like.

A body 410 of the cover 400 has double side portions 412 and a head portion 422, wherein the outer surface of the double side portions 412 are formed as tapered surface and the inner surfaces thereof are formed as plane surfaces 414 contacting the body of the thermal expansion valve 100. The outer surface of the head portion 422 is formed as a curved surface, and concave portions 424, 426 for storing the power element portion 36 of the thermal expansion valve are formed to the interior thereof. The power element portion 36 is inserted along the concave portions 424 and 426, and the cover 400 is mounted to the thermal expansion valve 100.

The depth size of the concave portions 424 and 426 are selected considering the position for storing the power element portion 36 when the cover 400 is mounted over the power element portion 36.

A plurality of projecting portions 416 is formed at the rear end of the inner surface 414 of the double side portion 412 of the cover body 410. When the cover 400 is mounted to the thermal expansion valve 100, the expansion valve body 110 is stopped against the projecting portions 416 and is positioned thereto.

A plurality of arcuate notches 418 is formed to the lower end of the projecting portion 416. The notches 418 are provided to avoid the interference of the bolt holes 50 for mounting provided to the thermal expansion valve body 110.

Moreover, in the cover 400 shown in FIGS. 22 and 23, projecting portion of the end side 224 formed in the cover 200 of FIG. 13 is omitted, and one portion of the power element portion 36, as is shown in FIG. 16, is exposed from the concave portion 426.

Figure 24:
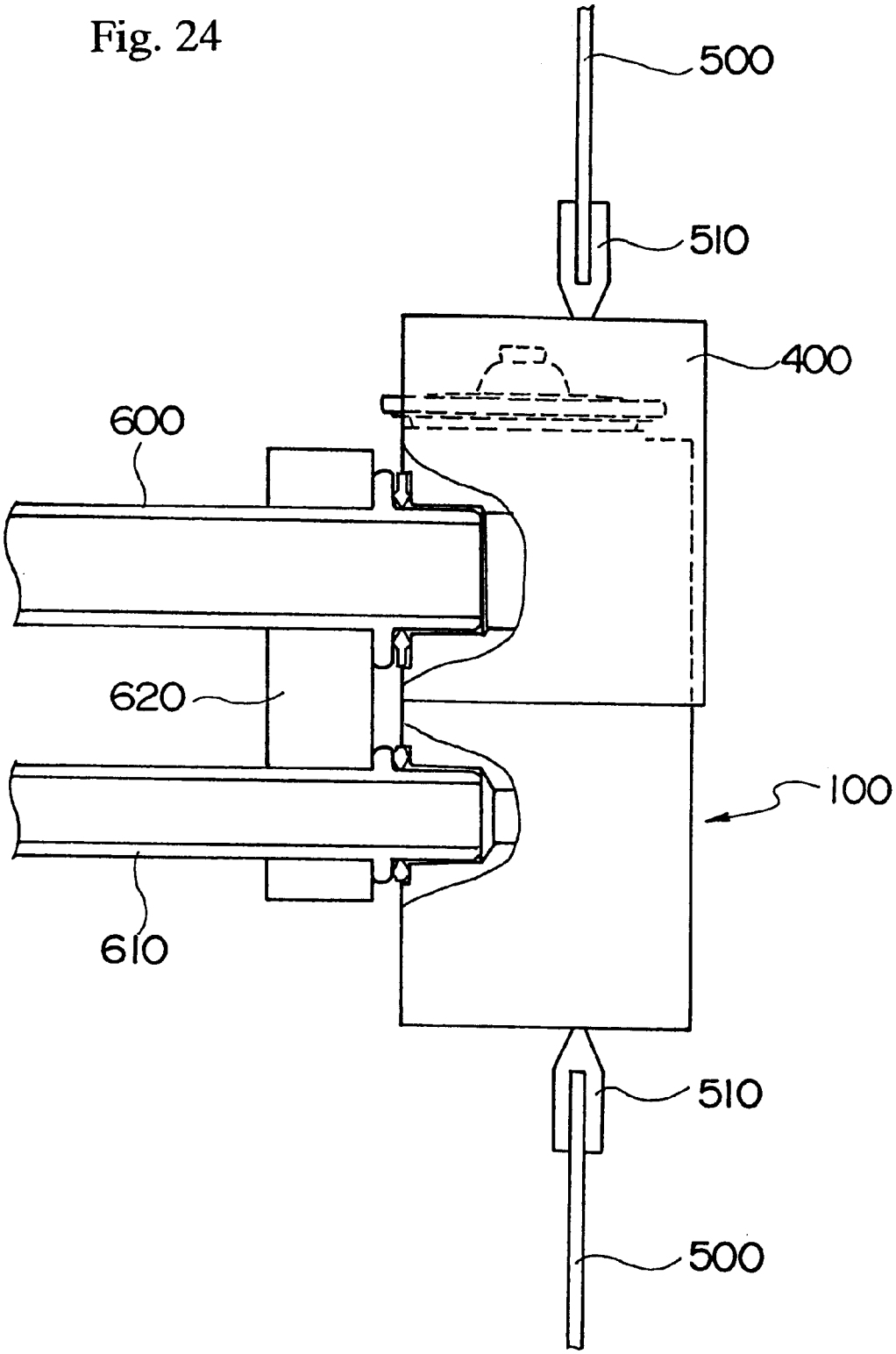
FIG. 24 is a side view showing the mounted state of the conventional thermal expansion valve.
Figure 25:
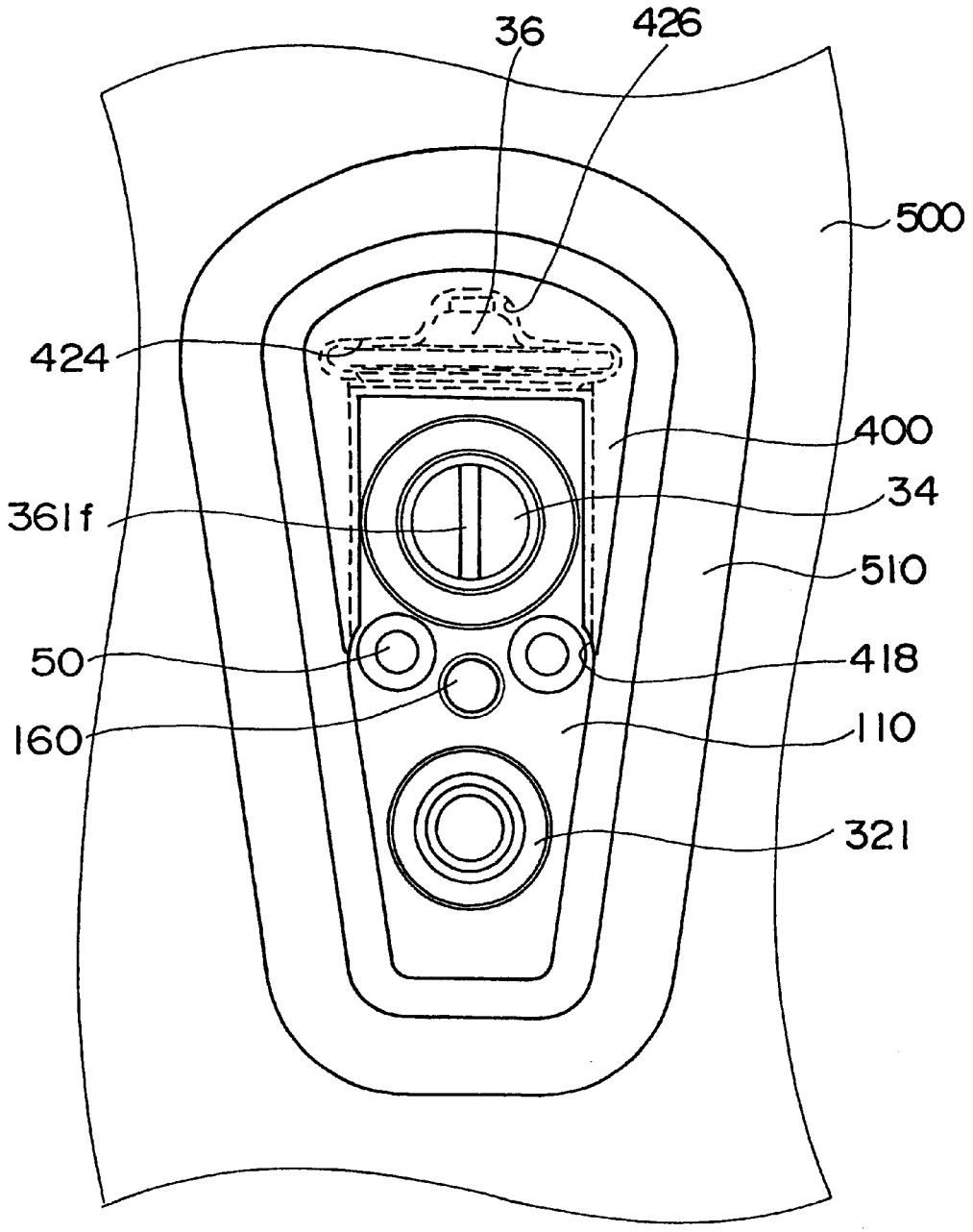
FIG. 25 is a front view showing the mounted state of the conventional thermal expansion valve.
Figure 26:
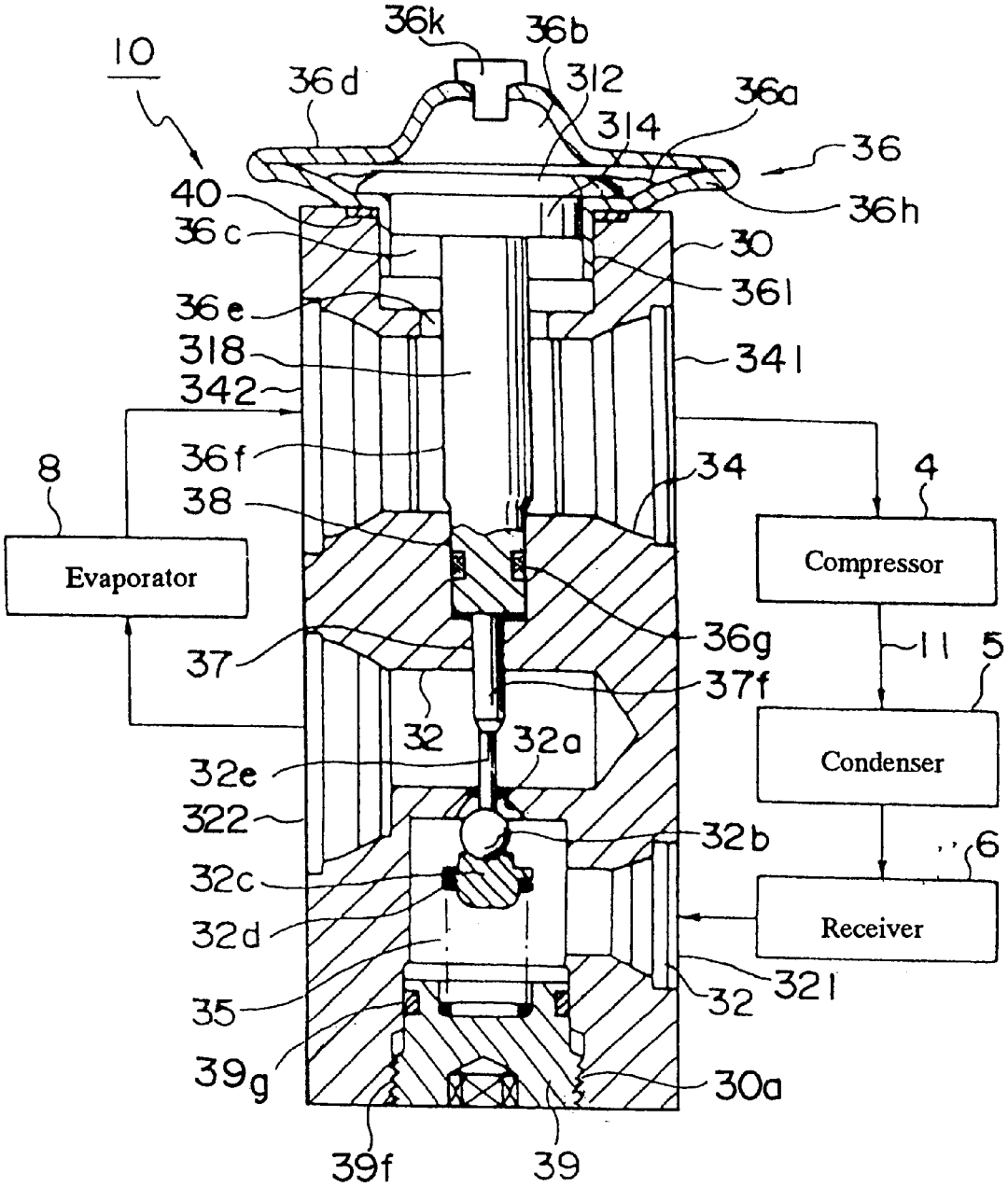
FIG. 26 is a longitudinal cross-sectional view of the conventional thermal expansion valve.
Figure 27:
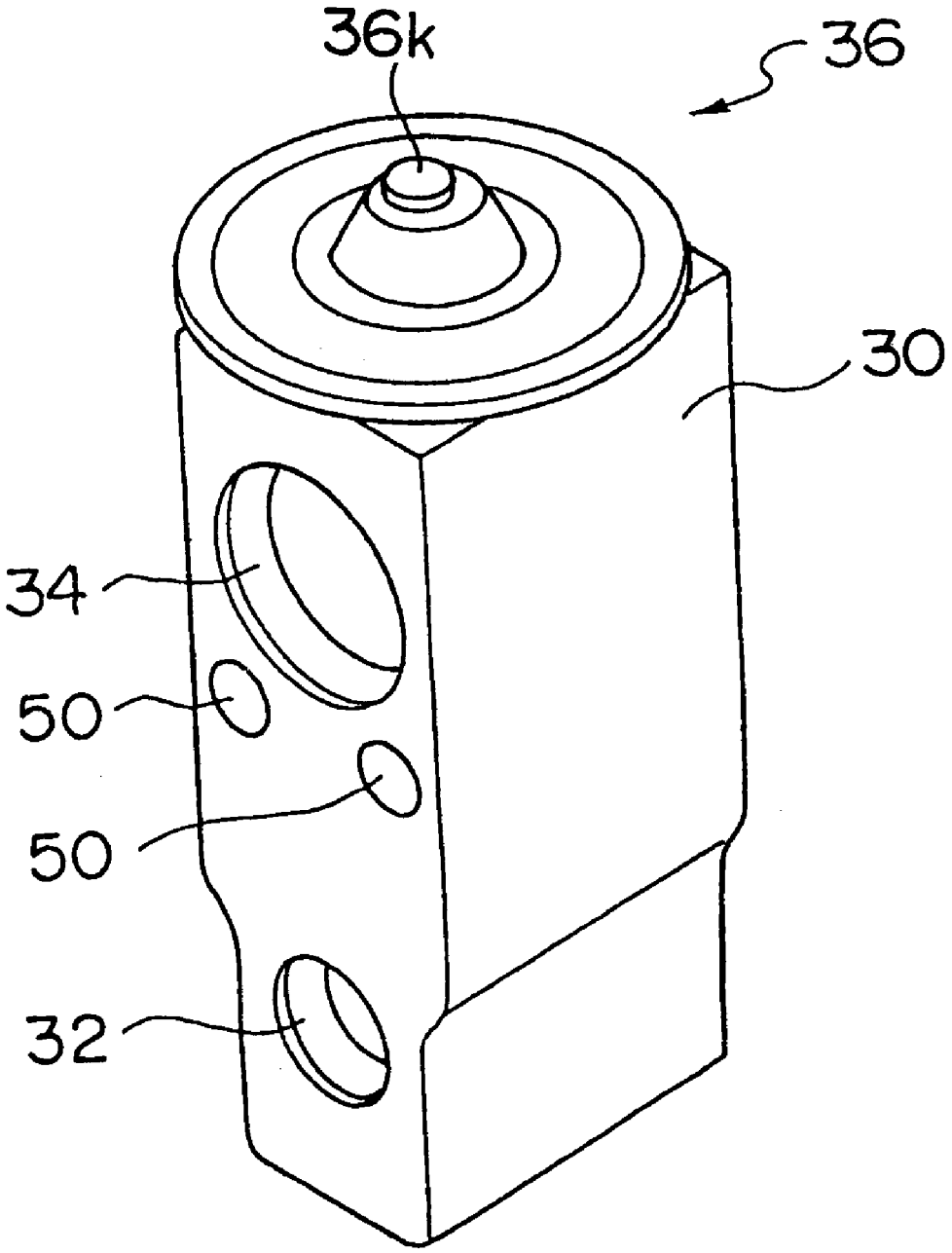
FIG. 27 is a schematic perspective view of another example of the conventional thermal expansion valve.
Figure 28:
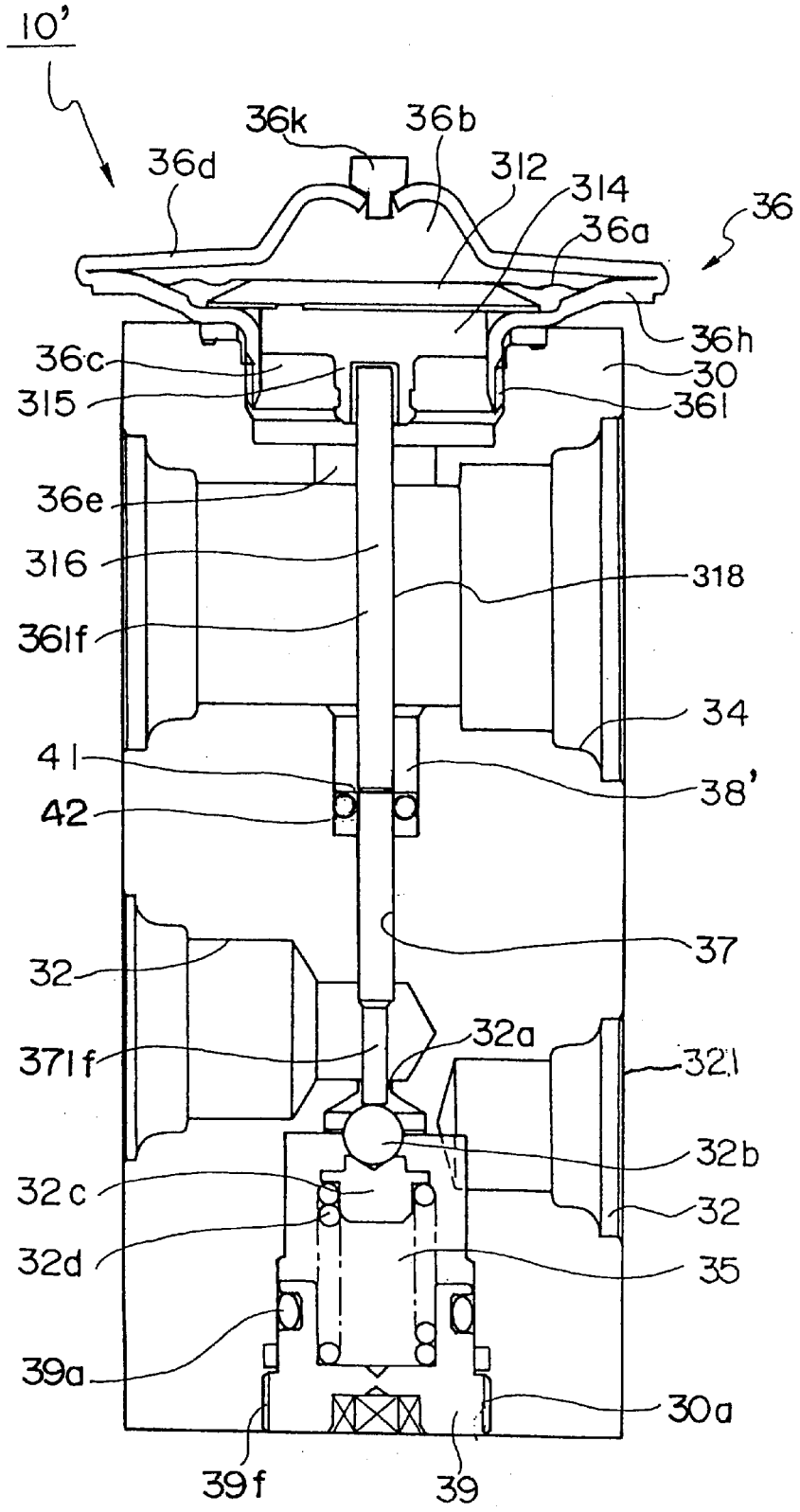
FIG. 28 is a cross-sectional view of another example of the conventional thermal expansion valve.

FIG. 24 is a side view showing the state where the thermal expansion valve 100 equipped with the cover 400 is mounted, for example, to an opening formed at a division 500 dividing the engine room and the passenger room of an automobile, and FIG. 25 is a front view thereof. The composition is the same as that explained for FIGS. 14 and 15, therefore identical portions are given identical reference numbers and explanations thereof are omitted.

As seen from above, the present invention enables to adjust the shape of the outer peripheral of the power element portion by covering the thermal expansion valve used in the refrigeration cycle for a car air conditioner and the like with a cover. Therefore, the present invention provides a thermal expansion valve having secure and good seal ability when fixing the thermal expansion valve to the division between the engine room and the passenger room of an automobile and the like.

We claim:

1. A thermal expansion valve, comprising:

a valve body, a lower portion of which has a tapered surface;

a power element portion provided to the upper end portion of said valve body which drives a valve means according to the displacement of a diaphragm;

an adjust screw, provided to the lower end portion of said valve body, which adjusts the pressurizing force of a spring controlling the valve opening of said valve means; and a cover, embracing the power element portion, and having an exterior formed with a plurality of tapered surfaces.

2. A thermal expansion valve, comprising:

a valve body, equipped with a first passage through which refrigerant entering an evaporator travels and a second passage through which refrigerant exiting said evaporator travels, and having a lower portion which has a tapered surface;

a valve, arranged opposing an orifice formed partway of said first passage and being biased toward a closed direction with a spring;

a power element that controls the opening of the valve, operated by sensing the temperature of said refrigerant traveling through said second passage and forcing said valve toward an open direction through a rod; and a cover, embracing the power element portion, and having an exterior formed with a plurality of tapered surfaces.

3. A thermal expansion valve according to claim 1 or 2, wherein said cover further includes an interior formed with a concave portion, and said exterior is further formed with a plurality of curvature surfaces with said plurality of tapered surfaces continue therefrom, said concave portion storing said power element therein, and said tapered surfaces being substantially continued from the tapered surfaces of said valve body.

4. A thermal expansion valve according to claim 3, wherein said tapered surfaces of said valve body are formed from substantially the middle of the total height of said valve body.

5. A thermal expansion valve according to claim 1 or 2, wherein said valve body is formed to have an outer shape comprising mutually parallel surfaces starting from the upper surface provided with said power element portion and extended to approximately the middle of the total height of said valve body, and tapered surfaces continued therefrom which is tapered toward a bottom surface provided with an adjust screw.

6. A thermal expansion valve according to claim 1 or 2, wherein said cover is formed as a single body using plastic material.

7. A thermal expansion valve according to claim 1 or 2, wherein said cover is formed from two parts using plastic material.

8. A cover for a thermal expansion valve, which comprises:

a concave interior portion that embraces a power element of said thermal expansion valve; and an exterior portion formed with a plurality of tapered surfaces.

9. A cover according to claim 8, wherein said plurality of tapered surfaces are substantially continued from a tapered surface of a lower portion of a valve body of said thermal expansion valve.

10. A cover according to claim 8, wherein said cover is formed as a single body using plastic material.

11. A cover according to claim 8, wherein said cover is formed from two parts using plastic material.

* * * * *